United States Patent [19]

Turner et al.

[11] Patent Number: 4,716,744

[45] Date of Patent: Jan. 5, 1988

[54] APPARATUS FOR WET TREATMENT OF CLOTH IN ENDLESS ROPE FORM

[75] Inventors: James K. Turner, Lincolnton; William C. Sturkey, Charlotte; Charles R. Hornbuckle, Lincolnton, all of N.C.

[73] Assignee: Gaston County Dyeing Machine Company, Stanley, N.C.

[21] Appl. No.: 508,383

[22] Filed: Jun. 27, 1983

[51] Int. Cl.[4] ..... D06B 3/28

[52] U.S. Cl. ..... 68/62; 68/178; 239/434.5

[58] Field of Search ..... 68/177, 178, 62; 239/433, 434.5, 456, 457, 472, 500

[56] References Cited

U.S. PATENT DOCUMENTS

| | | | |
|---|---|---|---|
| 1,916,946 | 7/1933 | Fruh | 8/151 |
| 2,211,059 | 8/1940 | Haas | 239/429 |
| 2,678,236 | 5/1954 | Tinker | 239/430 |
| 3,478,375 | 11/1969 | Buehl | 8/158 |
| 3,509,746 | 5/1970 | Muller et al. | 68/177 |
| 3,510,251 | 5/1970 | Fujii et al. . | |
| 3,556,409 | 1/1971 | Johannisson | 239/433 X |
| 3,587,256 | 6/1971 | Spara . | |
| 3,656,325 | 4/1972 | Peter | 68/177 X |
| 3,780,544 | 12/1973 | Turner et al. . | |
| 3,837,187 | 9/1974 | Trullas . | |
| 3,921,420 | 11/1975 | Aurich et al. | 68/178 X |
| 3,949,580 | 4/1976 | Trullas . | |
| 3,982,411 | 9/1976 | Kreitz | 68/177 |
| 4,019,351 | 4/1977 | Mizutani et al. . | |
| 4,036,038 | 7/1977 | Aurich et al. | 68/178 |
| 4,129,017 | 12/1978 | Greer | 68/177 |
| 4,210,005 | 7/1980 | Trullas . | |
| 4,261,511 | 4/1981 | Erb et al. | 239/434 X |
| 4,334,333 | 6/1982 | Yamada et al. | 68/177 X |
| 4,392,365 | 7/1983 | Miyamoto et al. | 68/177 X |

FOREIGN PATENT DOCUMENTS

| | | | |
|---|---|---|---|
| 934645 | 11/1955 | Fed. Rep. of Germany . | |
| 2439747 | 3/1976 | Fed. Rep. of Germany | 68/177 |
| 2007113 | 1/1970 | France | 68/177 |
| 486431 | 9/1969 | Japan | 68/177 |
| 53-14880 | 2/1978 | Japan . | |
| 2004927 | 4/1979 | United Kingdom | 68/177 |

*Primary Examiner*—Harvey C. Hornsby

*Assistant Examiner*—Frankie L. Stinson

*Attorney, Agent, or Firm*—Shefte, Pinckney & Sawyer

[57] ABSTRACT

Apparatus for wet treatment of cloth in endless rope form through a treating chamber in the presence of a treating liquid, with the cloth rope being circulated through a cloth return tube that communicates with the ends of the treating chamber. A front venturi introduces treating liquid into the cloth return tube to apply impetus to the cloth rope to draw it from the treating chamber and circulate it back through the cloth return tube into the other end of the treating chamber. An optional rear venturi introduces treating liquid at the entry of the cloth return tube into the treating chamber to pull the cloth from the cloth return tube and direct the cloth and treating liquid upwardly against a deflecting plate that is adjustbaly positioned in the treating chamber to intercept the cloth and treating liquid, with the deflecting plate opening the cloth to substantially the full width of the treating chamber and direct it upwardly and forwardly for forming into folds that compact to form a plug of the cloth rope that progresses through the treating chamber. The circulating treating liquid is maintained at a predetermined level in the treating chamber and the deflecting plate directs the cloth above the liquid level so that air is entrained in the folds of the cloth plug to facilitate reorienting of the cloth as it is formed into folds and, thereby, minimizes creasing. The cloth plug is formed with an exposed portion above the level of the treating liquid in the treating chamber which exposed portion is sprayed with circulating treating liquid from a plurality of openings spaced longitudinally along the top of the inside of the treating chamber. The circulating liquid being sprayed from the openings provides multiple treatment locations for the progressing cloth plug and wets the interior surface of the treating chamber to prevent condensation and dripping of condensate onto the exposed portions of the cloth plug.

The front venturi is incorporated in a liquid injection nozzle assembly that is removably mounted in the cloth return tube and has nozzle segments that are removable and adjustable in spacing to allow for modification of the capacity of the venturi to suit necessary handling requirements for various weight and type fabrics being treated.

28 Claims, 27 Drawing Figures

Fig. 3
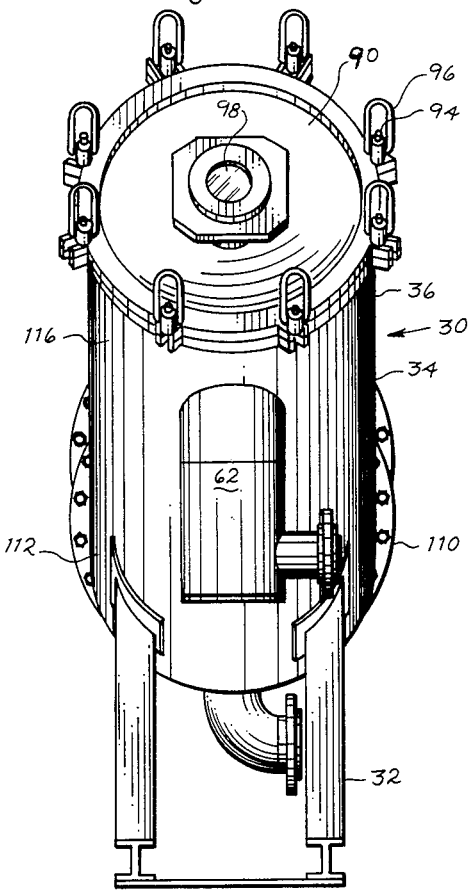
Fig. 4
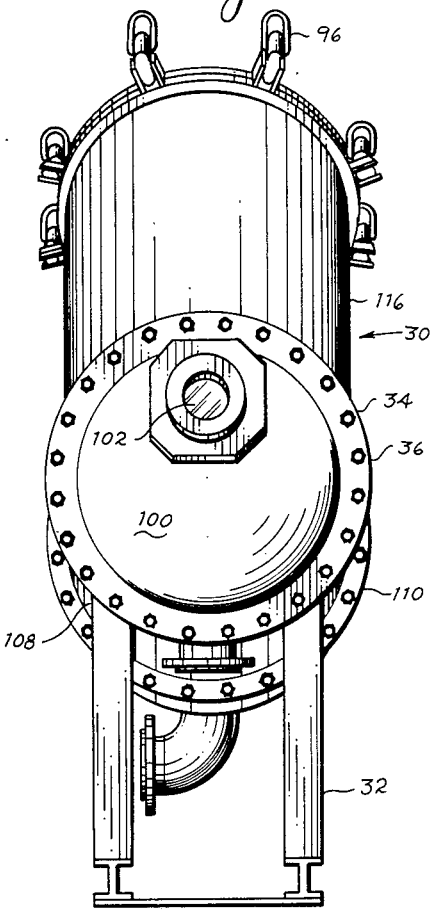
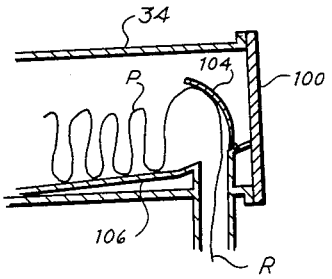
Fig. 15
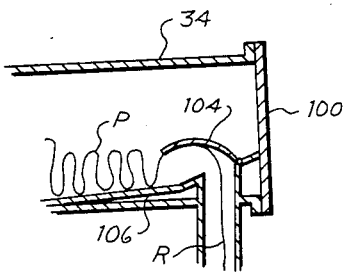
Fig. 16
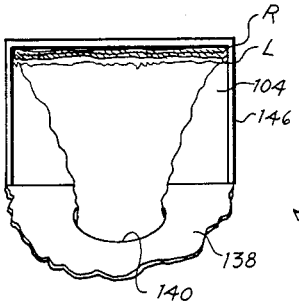
Fig. 17

Fig 10
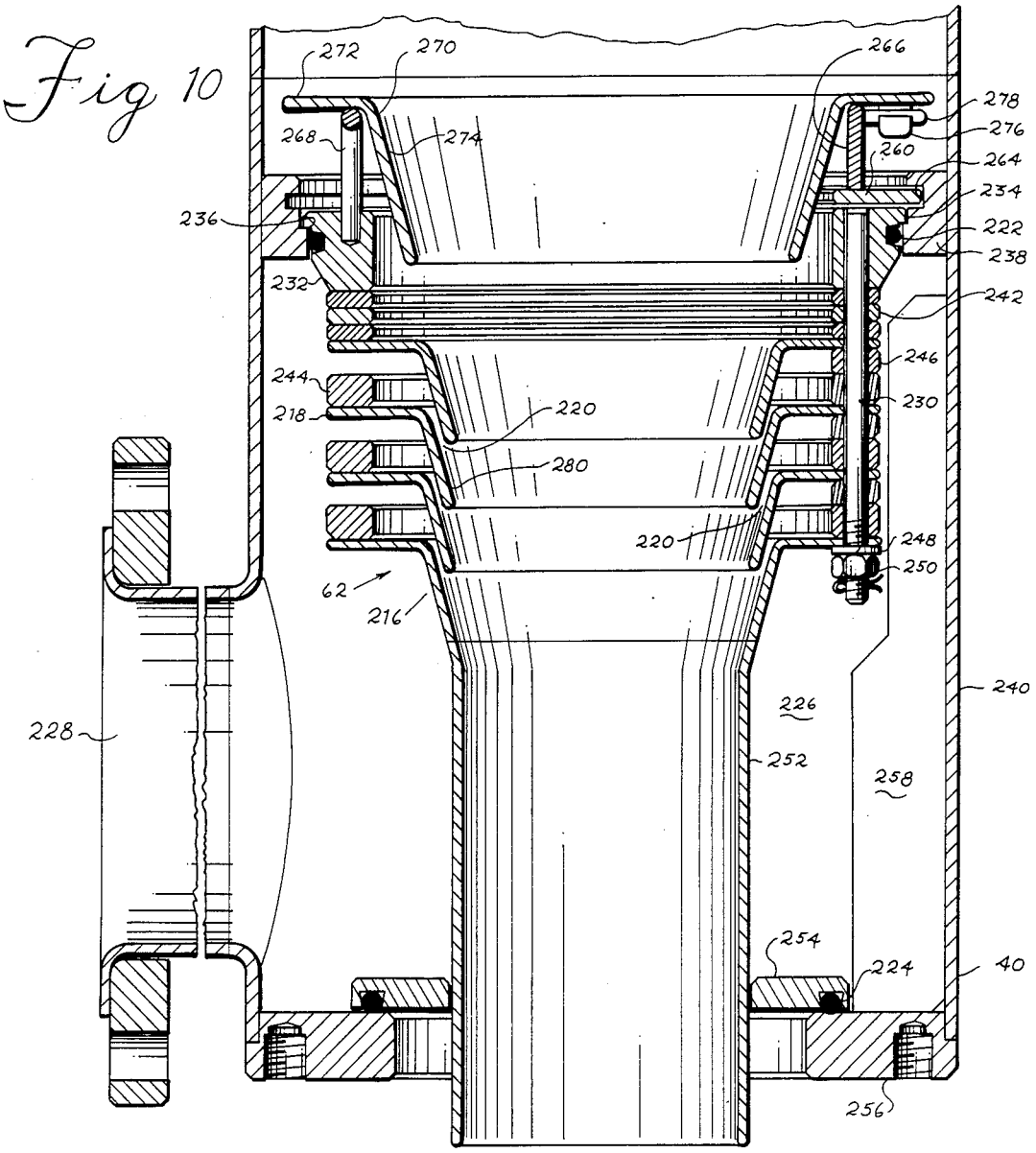
Fig. 18
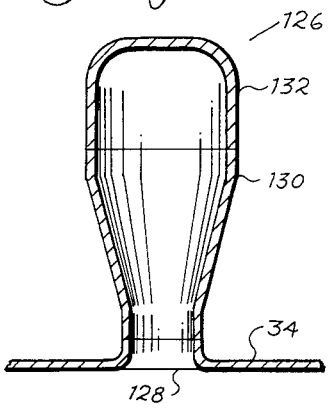
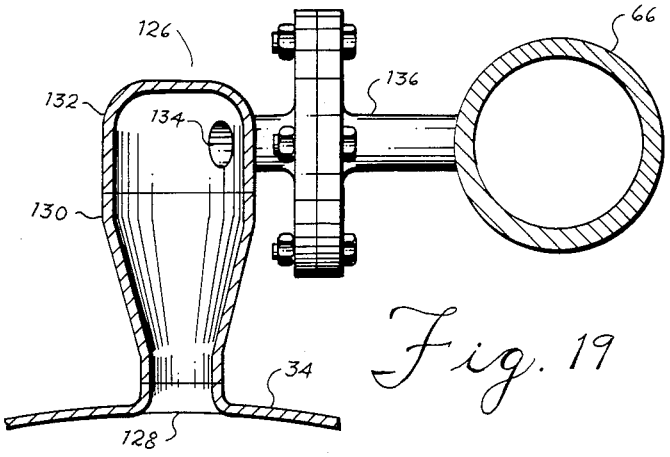
Fig. 19

Fig. 20
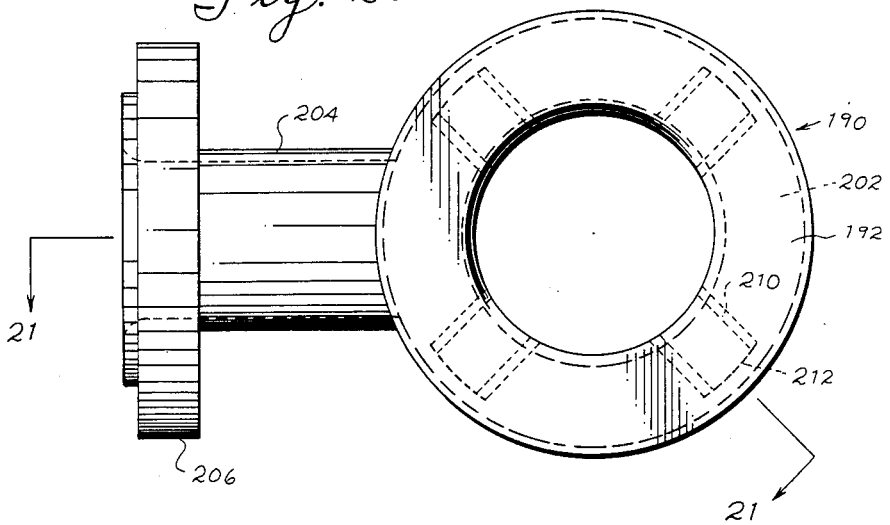
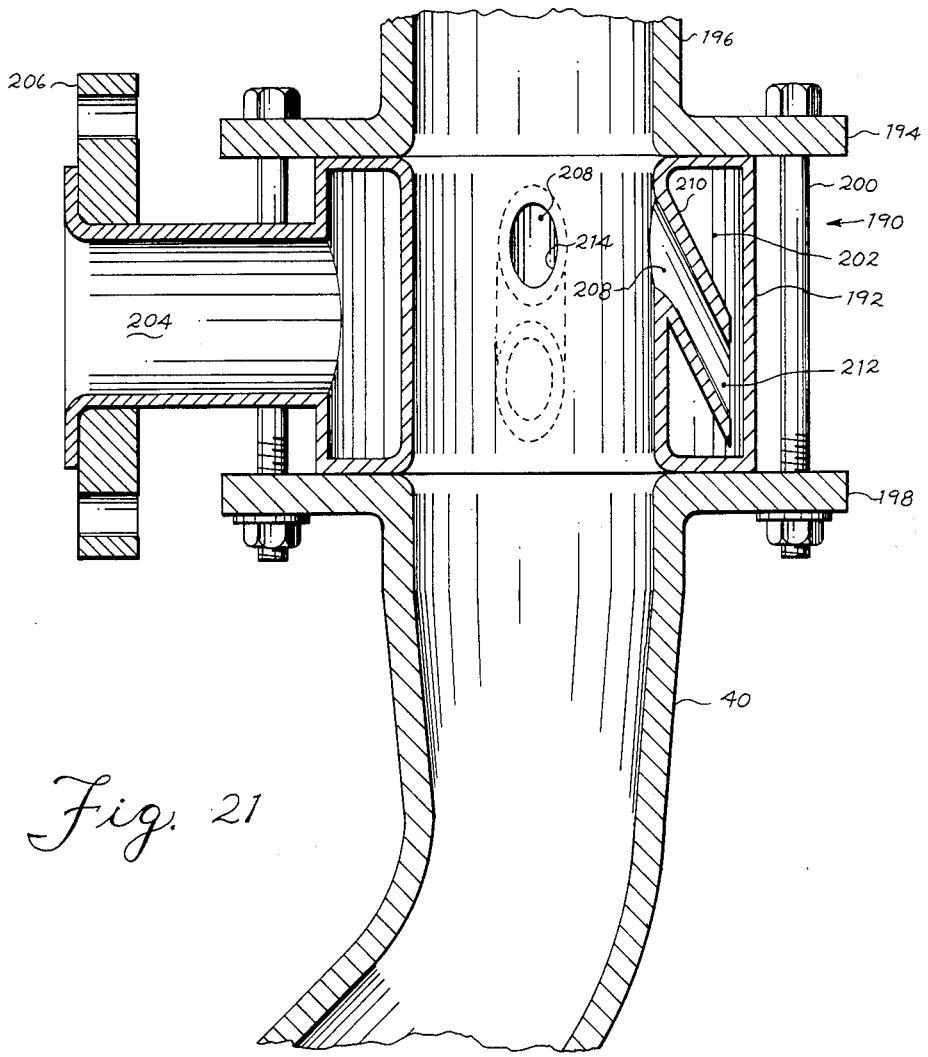
Fig. 21

APPARATUS FOR WET TREATMENT OF CLOTH IN ENDLESS ROPE FORM

BACKGROUND OF THE INVENTION

The present invention relates to apparatus for wet treatment of textile material in the form of an endless cloth rope that is circulated through a liquid treating chamber, and more particularly to such an apparatus wherein the cloth rope is fed into a generally horizontal treating chamber in vertical folds to form a cloth plug for effective application of the treating liquid to the textile material as it progresses through the chamber.

In the context of this invention, the term "cloth" encompasses all types of textile materials capable of being handled in rope form, such as woven, knitted, or non-woven and various types of natural and synthetic materials, and the treatment can be dyeing or washing or any other type of liquid treatment.

Machines of this general type are well known in the art and usually include as adjuncts to the generally horizontal liquid treating chamber a cloth return tube above or below the chamber and connected to its ends. A liquid circulating system directs the liquid through the return tube as well as into the treating chamber, with a cloth reel and/or a liquid nozzle for circulating the cloth rope through the treating chamber and the return tube and with a heat exchanger included where needed to raise and maintain the temperature of the treating liquid at some predetermined temperature. These machines are generally capable of treating most fabrics adequately with desirable characteristics of gentle handling of the fabric to avoid damage, minimizing of crease marks and other blemishes that effect quality and low liquor ratios that minimize the amount of treating liquid needed. However, there are limitations in the usefulness of these machines to produce acceptable results with some fabrics, such as lightweight delicate fabrics, and there are limitations in cycle time, such that there has been a desire in the industry to strive for improvement of these characteristics to obtain enhanced and more economical results with all fabrics and in shorter cycle times.

Damage to the fabric being treated due to mechanical handling as the cloth rope is recirculated through the prior art machines prevents use of the machines to treat delicate fabrics or limits the speed at which the machines can be operated so that appreciable damage will not occur. The quality of the treated fabric is adversely affected by improperly treated marks resulting from creases unavoidably formed in the fabric during folding in the formation of the cloth plug and by dripping of condensed liquid from the top of the treating chamber on to the cloth plug, particularly when a portion of the cloth plug is exposed above the level of the treating liquid in the chamber. Further, the cycle time of prior art machines is limited by the ability of a single venturi or jet nozzle, normally located in the return tube at the exit end of the liquid chamber, to impel movement of the cloth rope throughout the entire machine, which limits the speed at which the cloth rope can be circulated and imposes mechanical strain on the cloth rope when increased speeds are attempted.

Typical of the prior art is a machine marketed by Hisaka Works, Ltd., as Model CUT-FL. This machine has a generally horizontal treating chamber through which the cloth rope travels in vertical folds as a plug and is drawn from the chamber and impelled through the return tube by a treating liquid nozzle located in the return tube adjacent the exit end of the treating chamber. This nozzle provides the only cloth impelling device in the system and the only location at which treating liquid is introduced. There is no means for applying liquid to the cloth rope during its progression through the treating chamber and no means is provided to avoid dripping of condensate from the top of the treating chamber onto the plug. A similar machine is shown in Platt International Ltd. U.S. Pat. No. 3,762,189, which, in addition, shows the return tube curved upwards and back on itself at the discharge of the cloth rope into the treating chamber and the tube increases in area to facilitate the passage of the fabric around the curve without objectionable crushing, but this outlet does not provide a full opening of the fabric from the rope form to the plug form as it enters the chamber. This curved discharge end of the cloth tube is modified by the addition of a trumpet in the form of the machine marketed as Platt Longclose Uniflow, which allows for opening of the fabric, but does not positively provide for opening of the fabric as it is formed into vertical folds. Thus, both of these Platt constructions do not minimize substantially the formation of creases during the fold formation. Two generally similar machines are marketed by ATYC of Spain, one is designated at the Rapid Suau S, which has a trumpet shaped flared discharge end to the cloth tube where the cloth is discharged into the treating chamber, and in the Rapid Suau Spiral form of the machine the cloth tube is discharged downwardly from the return tube onto a perforated plate, and in addition there is a series of sprays that spray treating liquid onto the plug in a portion of its travel through the treating chamber, but the spray does not act throughout the extent of the exposed portion and does not act over the surface of the chamber to eliminate dripping. Sprays are also disclosed in Burlington Industries, Inc., U.S. Pat. No. 3,301,026, in which the sprays are used simply to maintain the cloth rope under the level of the treating liquid in the treating chamber, and in Kawasaki U.S. Pat. No. 3,782,138, in which overflow troughs are provided above the cloth plug in the treating chamber for the same purpose. Another prior art example is Krantz U.S. Pat. No. 3,982,411, which discloses a flared discharge of the cloth rope from the return tube into the treating chamber, and also discloses a multiple inlet nozzle through which the treating liquid is injected to impel the cloth rope through the system, but the multiple opening nozzle is at only one location in the machine.

SUMMARY OF THE INVENTION

The improved features of the present invention combine to enhance the gentle handling, high quality, low liquor ratio and high speed characteristics of conventional horizontal type machines by utilizing an additional liquid venturi or jet nozzle in the cloth tube adjacent the entry end of the treating chamber to distribute the impelling forces on the cloth rope for gentler handling and/or higher cloth speed, a deflecting plate in the entry end of the treating chamber against which the nozzle directs the liquid and cloth rope for enhanced opening of the fabric and forming of it with air entrapment into vertical folds with minimal creasing, spray means for spraying treating liquid onto the cloth plug in the treating chamber to expedite the treatment along the length of the plug and assure uniformity of treatment of the portions of the plug exposed above the level of the treating liquid in the chamber, and a removable and variable capacity treating liquid venturi or jet nozzle in the cloth tube adjacent the exit end of the treating chamber to accommodate the system to the optimum flow conditions compatible with the effect of the entry end venturi or jet and the spray means on liquid flow.

The additional liquid venturi or jet in the cloth tube adjacent the entry end of the treating chamber may not be necessary for some fabrics and some flow rate conditions where the venturi or jet adjacent the exit end is sufficient to provide the necessary flow and the fabric is capable of withstanding the impelling forces from the single exit end nozzle, but by using the entry end venturi or jet in addition, the flow rate can be increased and/or the input flow can be distributed at the two venturis or jets so that severe impelling forces are not developed, which then allows the machine to handle more delicate fabrics and fabrics that tend to pill. The use of the entry end venturi or jet also provides an additional location at which fresh treating liquid is applied to the cloth rope during each circulation through the machine, thereby increasing the incidence of exposure of the cloth rope to fresh treating liquid during each circulation of the cloth rope through the machine and correspondingly reducing the number of circulations necessary to complete the treatment. Also, the use of the entry end venturi or jet serves to draw the cloth rope and treating liquid through the cloth tube rather than being only pushed through the tube by the exit end venturi or jet, which minimizes the distortion and creasing of the cloth rope as it progresses through the cloth tube and reduces the possibility of back flusing of the treating liquid into the treating chamber adjacent the exit and that can occur when the exit end nozzle is the sole hydraulic mover and the only location at which all of the treating liquid must be introduced into the system.

The advantage of the entry end nozzle is exemplified by the use of the apparatus to handle two lengths of fabric together in what is known as a "piggy-back" mode in which the leading end of one cloth rope is sewn to the other cloth rope with the trailing end of the one rope running free. With only the exit end nozzle, the entire propulsion force must be applied at the single exit end nozzle, but with the additional entry end nozzle the force can be divided so that less force, and therefor less harsh handling, is applied at each nozzle, thereby allowing higher speed cycling of normal fabrics and less damaging handling of delicate fabrics. There is also a minimization of the entangling effect on the two "piggy-back" ropes that occurs when they are pushed through the cloth return tube by a single exit nozzle and which can cause problems in separating the ropes when withdrawn from the apparatus at the end of a cycle.

In the deflecting plate feature of the present invention, the plate is disposed in the entry end of the treating chamber with the cloth tube opening from below to direct the treating liquid and cloth rope upwardly against the deflecting plate, which has a generally straight lateral extent substantially equivalent to the full width of the treating chamber and is inclined upwardly and progressively forwardly in its longitudinal extent so that it intercepts and redirects the treating liquid and cloth forwardly along its surface, with the treating liquid and cloth rope being circulated at a sufficient velocity to maintain the cloth rope in contact with the plate for a sufficient longitudinal extent to cause the cloth to open to substantially the full width of the treating chamber. The deflecting plate further causes the cloth rope to form into vertical folds that are compacted into the cloth plug for progressive movement through the treating chamber. Preferably, the deflecting plate is pivotally mounted and adjustable to vary the fold formation and, therefore, the plug formation, for which purpose it is preferably concavely shaped as a cylindrical segment and has depending sidewalls to contain the treating liquid and cloth in a forward direction. In the preferred embodiment, the deflecting plate directs the cloth rope forwardly above a predetermined liquid level in the treating chamber to entrain air in the cloth folds and form the plug of a predetermined height extending above the liquid level.

The functioning of the deflecting plate to open the cloth rope to substantially the full width of the treating chamber and to reorient the fabric material while entraping air enhances the avoidance of formation of creasemarks and particularly the repetition of crease marks at the same locations such that more uniform treatment can be provided with higher quality results. Further the formation of the cloth plug at a height extending above the level of the treating liquid not only minimizes the formation of creases, but importantly allows less liquid to be used than in a totally submerged plug system, with a resulting low liquor ratio for more efficient and less expensive operation.

The spray means feature of the present invention is part of the treating liquid circulating means and serves to apply the treating liquid to the exposed portion of the cloth plug as it progresses through the treating chamber. This allows the apparatus to take advantage of the entrapment of air in the folding process by the deflecting plate so as to reorient the fabric and avoid creases. Further, in combination with the deflecting plate folding the cloth rope to form the plug with a portion exposed above the level of the treating liquid, the spray means assures uniform application of the treating liquid to the exposed plug such that the low liquid level can be effectively utilized at considerable cost and waste savings of a low liquor ratio. For this purpose, the spray means applies the spray across substantially the full width and length of the plug for uniform application of the treating liquid to obtain uniform, high quality treatment. This spray means provides a further advantage of minimizing contamination or staining of the material being treated that would otherwise occur from dripping of condensed liquid from the interior surface of the chamber wall above the plug onto the exposed portion of the plug. For this purpose, the spray means distributes the liquid over substantially the entire surface of the chamber above the liquid level, keeping the surface wet and preventing condensation on the wall, and additionally intercepting any possible drips that may occur.

The aforementioned uniformity of spray application and avoidance of condensation formation and dripping of the spray means of the present invention is advantageous as well in apparatus where there is no exposed portion of the cloth plug, as the even distribution of treating liquid and the avoidance of condensate dripping is beneficial in themselves. The addition of the treating liquid at a number of spray locations enhances the effectiveness of the treatment and considerably reduces the cycle time in comparison with conventional systems where the treating liquid is introduced only at the venturi or jet nozzle. Thus, the material is exposed to fresh treating liquid at more locations during each cycle and additions of chemicals or changes in temperature can be applied more rapidly in the cycle. This results in the apparatus being capable of considerably faster cycle times at a savings in time and cost or reasonable cycle times can be obtained at slower cloth rope speeds, such that the cloth can be handled with less wear and more delicate fabrics can, therefore, be treated by the apparatus, making it more universally applicable.

In the preferred embodiment of the spray means feature of the present invention, the spraying across substantially the full width and length of the cloth plug and over substantially the entire inner surface of the treating chamber above the cloth plug is facilitated by the spray means comprising a plurality of openings with a vortex chamber disposed above each opening. Each vortex chamber converges conically from an enlarged upper portion to the opening and has an entry opening in its upper portion to which a suppy conduit is connected generally tangentially for introduction of treating liquid through the conduit tangentially into the vortex chamber to cause the treating liquid to form a vortex as it flows downwardly through the vortex chamber and spray opening, thereby forming a dispersing spray in the treating chamber. Further, the spray openings flare circumferentially outwardly to merge into the interior surface of the treating chamber to facilitate the dispersion of the treating liquid spray as it enters the treating chamber. With this construction, substantially full dispersion of the treating liquid occurs in substantial surface contact with the treating chamber above the cloth plug, and this is accomplished without any protrusion from the chamber wall that could snag or otherwise damage the cloth rope as it progresses through the treating chamber. Further, because of the simple construction and the lack of moving parts, reliable operation is assured and clogging of the system is minimized.

The aforementioned treating liquid venturi or jet nozzle in the cloth tube adjacent the exit end of the treating chamber comprises a plurality of partially overlapping annular nozzle segments that are removably secured together in spaced relation to provide a plurality of nozzle openings for injection of treating liquid into the stream of traveling liquid and cloth rope. The removable securement of these nozzle segments allows the nozzle assembly to be adjusted to accommodate particular fabric and flow characteristics for particular operation in relation to the other components of the apparatus. In detail, the nozzle is in the form of a liquid injection nozzle assembly that includes spacer elements removably mounted between the nozzle segments to provide the nozzle openings and to permit variation of the spacer sizes for selected flow characteristics. The nozzle segments and spacer elements are secured together by a plurality of spaced assembly rods that extend through the nozzle segments and spacer elements. Each of the nozzle segments has an inner frusto-conical portion tapering inwardly in the direction of flow of the treating liquid through the nozzle and with the frusto-conical portions of adjacent nozzle segments partially overlapping inwardly in spaced relation and in a downstream direction so that the nozzle openings face downstream to impart a moving force on the stream and cloth rope. The nozzle assembly is retained in the cloth tube or other adjacent structure by a plurality of arcuately shaped latching elements pivotally mounted on the assembly for outward movement to latch in a groove of a cloth tube or other surrounding structure. These latching elements are preferably disposed at the upstream end of the nozzle assembly and an annular latch retaining segment is removably mounted over the latching elements in the upstream direction and has an inner frusto-conical portion tapering inwardly in the downstream direction in retaining engagement with the latching elements inwardly thereof to retain the latching elements in latching disposition.

While each of the aforementioned features of the present invention are interrelated and combine to provide enhanced handling, quality, low liquor ratio and high speed characteristics, each of these features provide significant advantages by themselves when used separately for various purposes in other apparatus.

BRIEF DESCRIPTION OF THE DRAWINGS

FIG. 3 is an end elevation of the treating chamber of the apparatus of the present invention as viewed from the exit end at the left of FIG. 1;

FIG. 4 is an end elevation of the treating chamber of the apparatus of FIG. 1 as viewed from the entry end at the right in FIG. 1;

FIG. 10 is a vertical section along the center line of the liquid injection nozzle assembly of the present invention mounted in the cloth tube adjacent the exit end of the treating chamber of the apparatus of FIG. 1;

FIG. 15 is a diagramatic vertical section of the entry end of the treating chamber showing the deflecting plate in a raised position and showing the cloth rope being folded thereby to form a plug;

FIG. 16 is a view similar to FIG. 15 showing the deflecting plate in its lowered position;

FIG. 17 is a diagramatic elevation looking into the deflecting plate of FIG. 15 and illustrating the opening of the cloth rope as it progresses along the deflecting plate;

FIG. 18 is a vertical section of one of the vortex chambers of the spray means of the apparatus of FIG. 1 as viewed along the center line of the treating chamber facing the apparatus as viewed in FIG. 1;

FIG. 19 is a vertical section of the vortex chamber and connecting conduit as viewed facing the entry end of the treating chamber of FIG. 1;

FIG. 20 is a plan of an alternate form of the liquid jet means adjacent the entry end of the treating chamber of the apparatus of FIG. 1;

FIG. 21 is a vertical section of the liquid jet means of FIG. 20 as viewed along line 21—21 of FIG. 20;

DETAILED DESCRIPTION OF THE PREFERRED EMBODIMENTS

Figure 2:
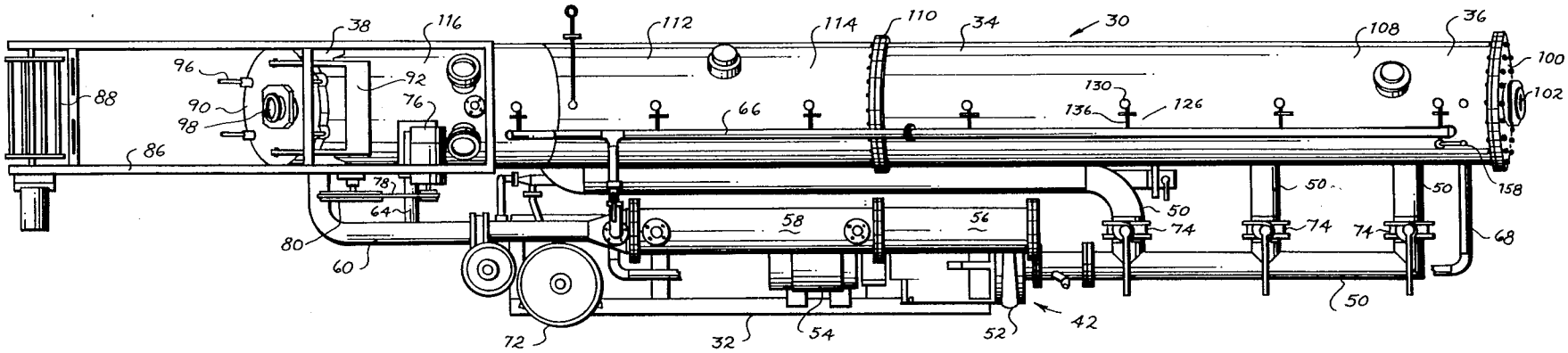
FIG. 2 is a plan of the apparatus of the present invention.
Figure 1:
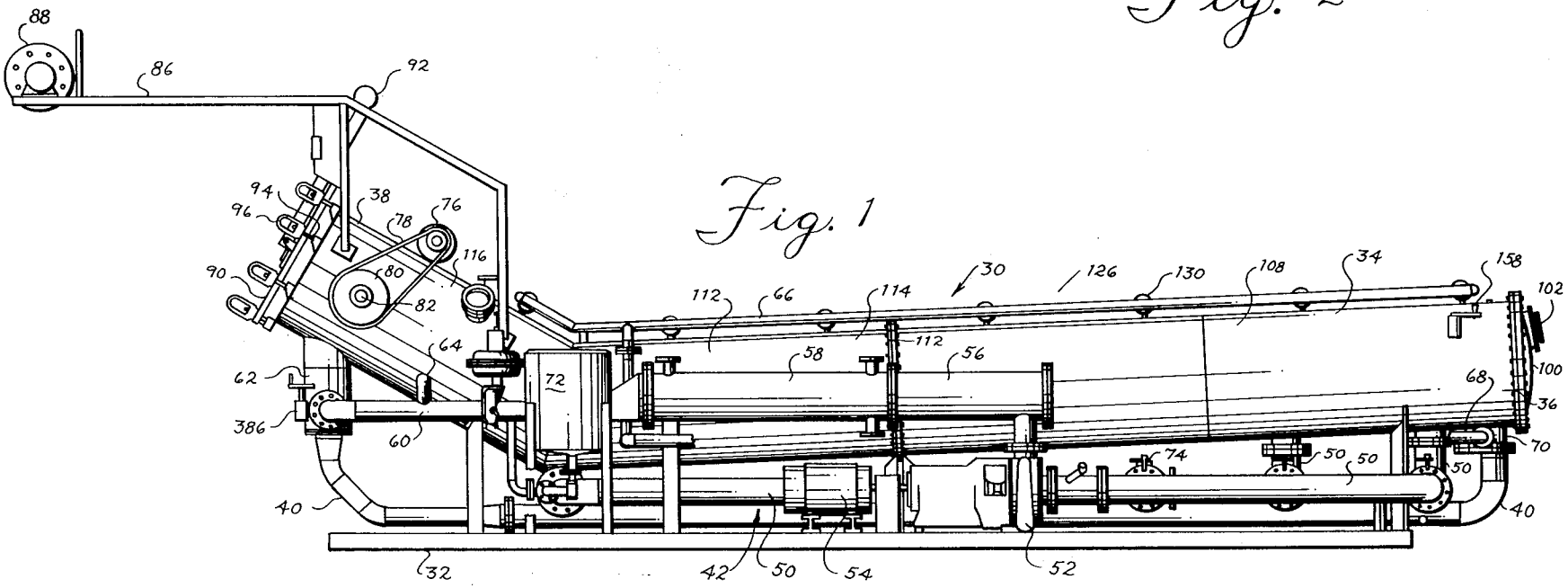
FIG. 1 is a side elevation of the preferred embodiment of the apparatus for wet treatment of cloth according to the present invention.
Figure 5:
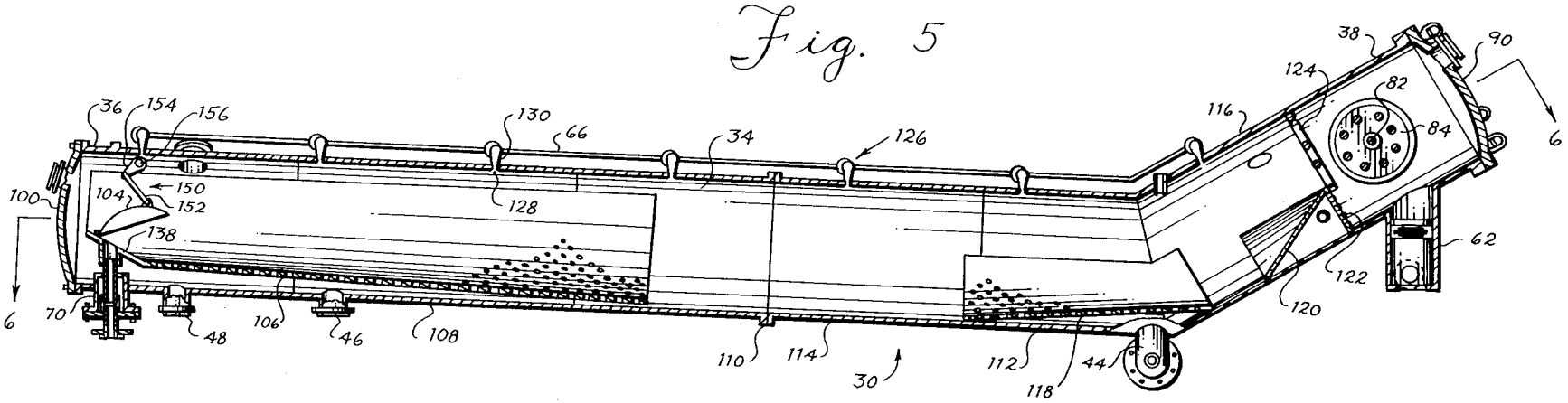
FIG. 5 is a vertical section of the treating chamber as viewed from the side opposite the side illustrated in FIG. 1 and taken along line 5—5 of FIG. 6.
Figure 6:
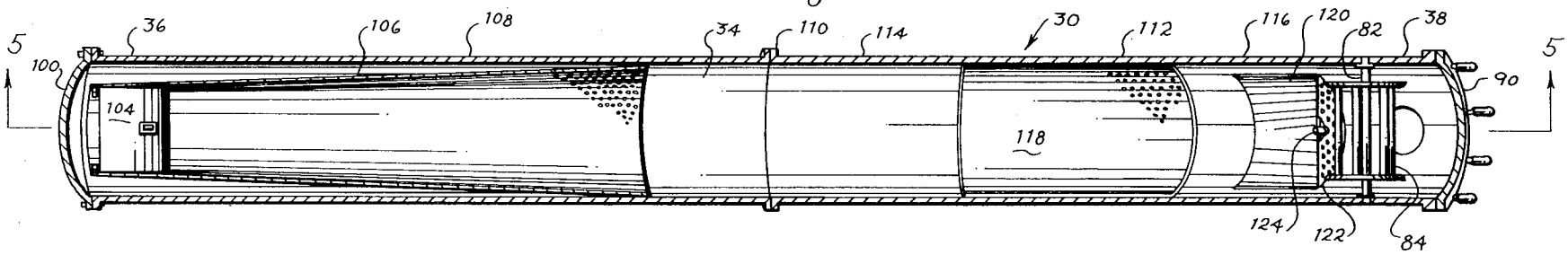
FIG. 6 is a horizontal section of the treating chamber taken along line 6—6 of FIG. 5.
Figure 9:
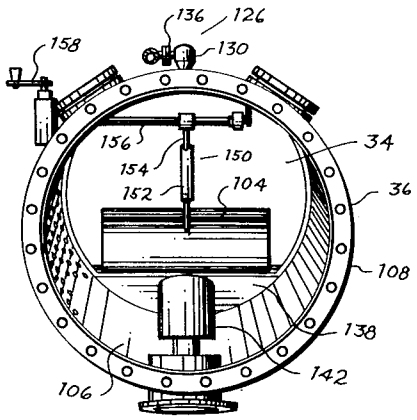
FIG. 9 is an end view of the right hand portion of the treating chamber of FIG. 1 as viewed toward the entry end.
Figure 8:
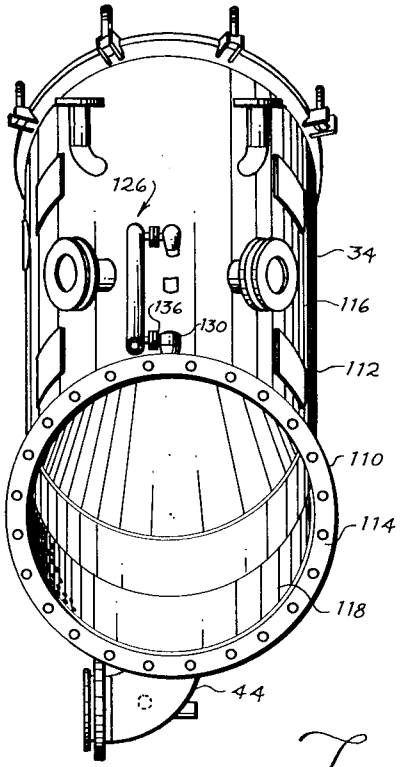
FIG. 8 is an end view of the left hand portion of the treating chamber of FIG. 1 as viewed toward the exit end.
Figure 7:
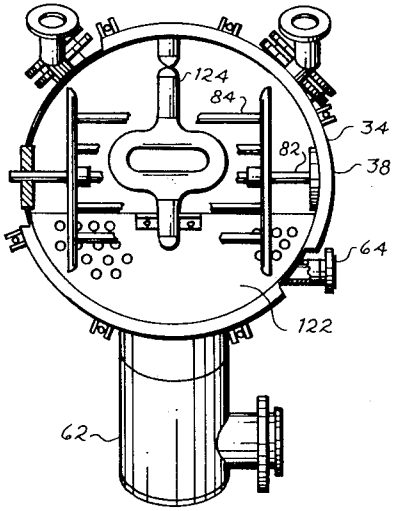
FIG. 7 is an end view, partially in section, looking into the exit end of the treating chamber with the cover plate removed.

Referring first to FIGS. 1 and 2, the apparatus 30 for wet treatment of cloth in endless rope form according to the preferred embodiment of the present invention is shown with a supporting framework 32 for mounting the apparatus 30 on a floor, with the framework 32 supporting a cylindrical treating chamber 34 having a rear or entry end 36 at the right in FIGS. 1 and 2 and a front or exit end at the left in FIGS. 1 and 2. The treating chamber 34 extends generally horizontally and is supported above the floor by the framework 32 with sufficient space thereunder for a cloth return tube 40 that extends from under the rear entry end 36 of the chamber 34 to the front exit end 38 for circulation through the cloth return tube 40 and treating chamber 34 of a cloth rope of fabric material that is to be treated in the apparatus 30.

Liquid circulating means 42 is provided for circulating treating liquid through the treating chamber 34 and cloth return tube 40 to treat the cloth rope and to provide the means for transporting the rope through the apparatus 30. This liquid circulating means 42 includes a front drain 44 in approximately the lowermost location near the front of the chamber 34, an intermediate drain 46 toward the rear of the apparatus and a rear drain 48 adjacent the rear end 36. These drains 44, 46, and 48 are connected by conduits 50 to a centrifugal pump 52 driven by an electric motor 54 that causes the liquid to circulate from the treating chamber 34 through the pump 52 into a filter 56 and heat exchanger 58, from which the heated treating liquid is directed through four conduits: the first conduit 60 leading to a front or exit end liquid venturi or jet means 62, a second conduit 64 leading to an overflow section toward the front of the treating chamber 34, a third conduit 66 leading to spray means 126 spaced along the top of the treating chamber 34, and a fourth conduit 68 leading to a rear liquid venturi or jet means 70. An "add" tank 72 is provided for adding chemicals to the liquid circulating means 42, and a butterfly valve 386 is provided in the conduit 60 to the front venturi to allow slow startup of circulation of the liquid to the front venturi or jet means 62.

An electric drive motor 76 is mounted adjacent the front end 38 of the treating chamber 34 and is connected by a belt 78 and pulley 80 to a drive shaft 82 that extends into the front end 38 for rotatably supporting a cloth lifter reel 84.

A frame 86 is mounted on the front end 38 of the treating chamber 34 and projects upwardly and forwardly for mounting of a doffing reel 88 over which the cloth rope is trained in removing it from the chamber 34 after treatment.

A front cover plate 90 forms a closure over the front end 38 of the treating chamber 34 and is secured to a lever 92 that is mounted for pivoting on the chamber 34 for opening and closing of the front cover plate 90, which is secured in sealed closed position by bolts 94 that are swingably mounted on the end of the chamber 34 and swing into engagement with the front cover plate 90 and are locked in place by locking nuts 96. An observation port 98 is provided in the front cover plate 90 for observation by the operator of the operation of the system within the treating chamber 34. This front cover plate 90 and its components are illustrated in FIG. 3.

A rear cover plate 100 is removably bolted over the rear end 36 of the treating chamber 34 to sealingly close the rear end, and is provided with an access door 102. This is illustrated in FIG. 4.

The interior of the treating chamber 34 and the elements of the apparatus located therein are illustrated in FIGS. 5–9 in which it is seen that the rear liquid jet 70 impels the liquid and cloth rope upwardly into the rear entry end 36 against a deflecting plate 104 that intercepts the liquid stream and cloth rope and directs it forwardly and upwardly, and from which the rope falls into folds to form a cloth plug that advances forwardly in the chamber 34 on a rear perforated liner 106, which inclines downwardly and forwardly from a spacing above the bottom of the chamber 34 to a point in contact with the chamber bottom near the center of the chamber 34. This rear liner 106 is perforated to allow liquid to drain therethrough for removal through the rear drain 48 and intermediate drain 46 thereunder. The rear liner 106 is located in the rear section 108 of the treating chamber 34, which rear section is cylindrical in form and is mounted at a slight downwardly and forwardly inclination on the framework 32. This rear section 108 is secured at mating flanges 110 to a front section 112 that has a portion 114 formed as a continuation of the inclined cylindrical rear section 108 and intermediate its ends it is angled upwardly and forwardly to form an inclined portion 116 that terminates in the front exit end 38 of the treating chamber 34. A perforated front liner 118 is disposed in the bottom of the front section 112 inclining slightly forwardly and bridging the intersection of the extending portion 114 and inclined portion 116, thereby minimizing the effect on the progressing cloth plug of the severity of the change of direction from the extending portion 114 to the inclined portion 116 and providing a space below the front liner 118 at the transition through which treating liquid is drained from the perforations in the liner 118 into the front drain 44.

Mounted in the bottom of the front section 112 of the treating chamber 34 at a spacing from the front liner 118 is a plug stop plate 120 that is angled substantially upwardly from the inclined bottom of the front section 112. The plug stop plate is imperforate and provides a space thereunder for introduction of treating liquid through the aforementioned overflow section conduit 64. The plug stop plate 120 extends to a horizontal level above that of the front venturi or jet means 62 so that the treating liquid introduced under the plug stop plate 120 will fill the space and overflow into the front venturi. A perforated shield plate 122 extends between the upper end of the plug stop plate 120 and the bottom of the treating chamber 34 to prevent the cloth rope from plugging into the space under the plug stop 120.

A pot eye bracket 124 is secured to and between the top of the plug stop plate 120 and top of the treating chamber 34 to provide a pot eye through which the cloth rope is trained as it is pulled from the cloth plug over the lifter reel 84 and through the front jet means 62 by the force of the rotating lifter reel 84 and the treating liquid being introduced through the front jet means 62 in the downward direction into the cloth return tube 40.

Spray means 126 extends across the top of the treating chamber 34 to spray treating liquid substantially across the full width and length of the cloth plug progressing through the treating chamber 34 and to wet substantially the entire inner surface of the treating chamber above the cloth plug to prevent condensation and dripping of treating liquidd from the treating chamber surface onto the cloth plug. This spray means 126 includes a plurality of openings 128 spaced lengthwise along the top of the cylindrically domed treating chamber 34 intermediate its ends and being disposed and shaped for distribution of the treating liquid across substantially the full width of the cloth rope plug and along substantially the full length thereof for treating the plug and for progressively adding to the treating liquid in the chamber to facilitate treating of the plug as it progresses through the chamber 34. Further, the openings 128 are disposed and shaped to direct the treating liquid over substantially the entire interior surface of the treating chamber 34. Mounted on the treatment chamber 34 above each opening is a vortex chamber 130 that converges conically to the opening 128 from an enlarged upper portion 132 that projects upwardly above the treating chamber 34. An entry opening 134 (FIGS. 19 and 24) is formed in this upper portion 132 for connection of a feed tube 136 extending from the aforementioned spray means conduit 66 and extending generally tangentially with respect to the vortex chamber 130 for introduction through the feed tube 136 into the vortex chamber 130 of treating liquid tangentially to cause the treating liquid to form a vortex as it flows downwardly through the vortex chamber 130 and spray opening 134 to form a dispersing spray in the treating chamber 34. The spray openings 134 flare circumferentially outwardly to merge into the interior surface of the treating chamber 34 to facilitate dispersion of the treating liquid spray as it enters the treating chamber 34 and to maintain it in surface wetting contact with the inner surface of the treating chamber 34.

Figure 22:
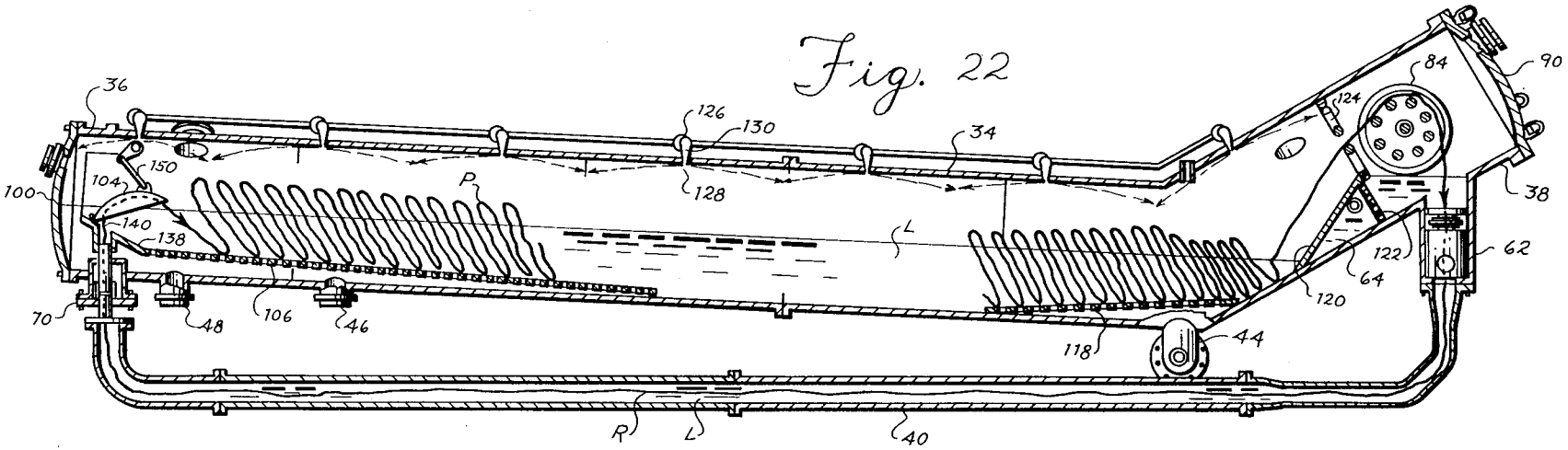
FIG. 22 is a vertical section of the treating chamber and cloth return tube of the apparatus of FIG. 1 and illustrating the location of the cloth rope and treating liquid during operation of the apparatus.
Figure 23:
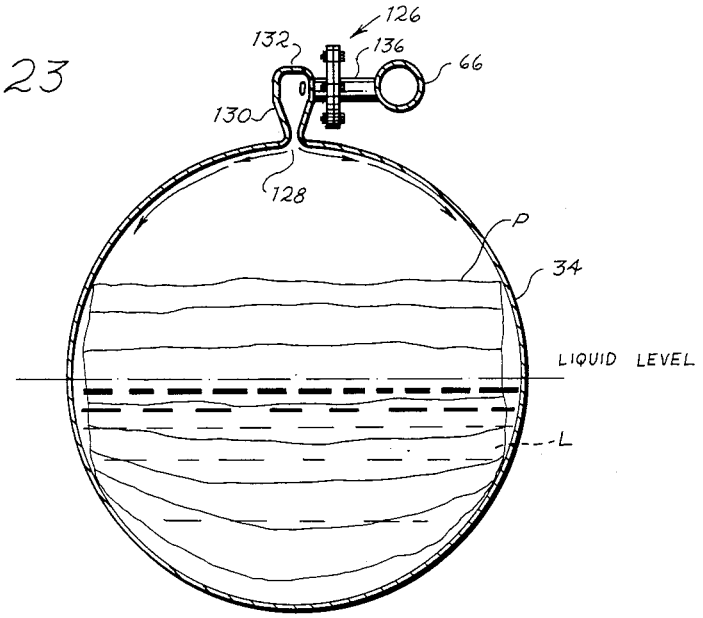
FIG. 23 is a transverse vertical section of the treating chamber of FIG. 22 taken through one of the vortex chambers and showing the disposition of the cloth plug and treating liquid in the chamber.
Figure 24:
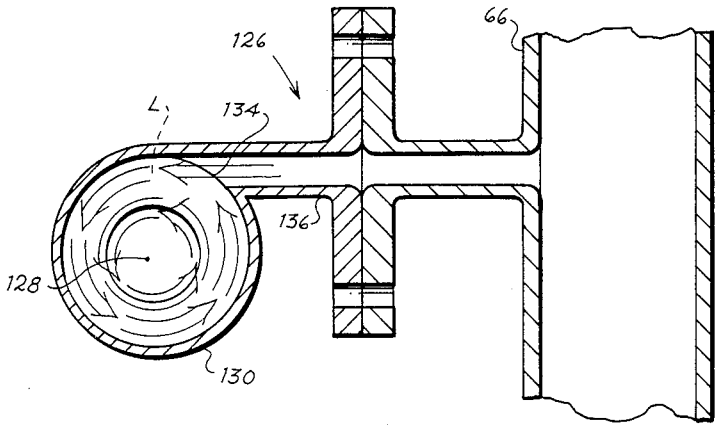
FIG. 24 is a horizontal section of the vortex chamber and connecting conduit of FIG. 23 showing the vortex action of the treating liquid therein.

With this spray means arrangement, the treating liquid circulated from the conduit 66 through the feed tube 136 entering tangentially into the vortex chamber 130 creates a swirling vortex, as indicated in FIG. 24, that converges and increases in velocity as it progresses down the walls of the vortex chamber 130 to the opening 128 and follows the flare of the opening so as to continue following the contour of the interior surface of the treating chamber 34 outwardly in all directions as indicated in FIGS. 22 and 23. The flaring of the openings 134 also results in a smooth transition without any sharp edges or any projections into the treating chamber 34 that could obstruct or snag, or otherwise damage, the cloth tube as it progresses in plug form through the treating chamber 34 beneath the openings 134.

The aforementioned deflecting plate 104, as seen in FIGS. 4, 5, 9, and 13, is mounted on an entry plate 138 that is bolted to the rear end of the rear liner 106 and extends rearwardly and upperwardly at a rearward inclination. This entry plate 138 contains an entry opening 140 and a downwardly projecting tubular duct 142, through which duct and opening the cloth rope and circulating treating liquid enters the treating chamber 34 from the cloth return tube 40 in a generally vertical direction. The deflecting plate 104 is pivoted to a hinge plate 144 that is bolted to the entry plate 138 adjacent the rearward edge of the entry opening 140 so that the deflecting plate 104 extends upwardly and forwardly over the opening 140. The deflecting plate 104 has a generally straight lateral extent substantially equivalent to the full width of the treating chamber 3A and is inclined upwardly and progressively forwardly in a concavely shaped contour. Side walls 146 project downwardly from the lateral edges of the plate 104 so that the deflector plate 104 has the appearance of a segment of a closed end cylinder.

The cloth rope and treating liquid circulating through the entry opening 140 are propelled with sufficient velocity to cause the treating liquid and cloth to follow the surface of the deflecting plate 104, which uniquely causes the cloth rope to spread laterally and open from the constricted rope form to substantially the full width of the treating chamber 34 as it leaves the forward edge 148 of the deflecting plate 104 and forms into the cloth plug that progresses through the treating chamber 34.

The angle at which the deflecting plate 104 projects forwardly over the entry opening 140 determines the shape of the cloth plug being formed. For this purpose the deflecting plate 104 is adjustable by an articulated linkage 150 that has one arm 152 pivoted to the top of the deflecting plate 104 adjacent its forward end and another arm 154 pivoted to the first arm 152 and fixed to a control shaft 156 that extends laterally across the top of the treating chamber 34 and projects outwardly therefrom. An exterior crank 158 is mounted on the shaft 156 exteriorly of the treating chamber 34 for manual manipulation of the linkage 150 to adjust the inclination of the deflecting plate 104. This adjustment of the deflecting plate 104 permits the apparatus to accomodate different weights of fabric and differing height plug formations. Further, the circulating liquid in the treating chamber 34 is controlled to maintain a generally constant, predetermined liquid level within the treating chamber 34, and the deflecting plate 104 is adjusted to direct the cloth rope forwardly in open condition above the level of the liquid, thereby causing the rope to entrain air and form the cloth plug with a height that projects above the level of the liquid. This entraining of air causes a re-arrangement of the fabric rope prior to its progression through the treating chamber 34, thereby minimizing the effect of deceleration of the cloth rope as it forms the plug and also reorients the folds in the cloth rope. This substantially eliminates the formation of corrugations and resulting creasing that has a tendency to occur in other machines of this general type that do not incorporate the deflecting plate 104 feature of the present invention. In this regard, there is an optimum amount of air entrainment for each particular condition and it is important to avoid too much air entrainment as this could create ballooning of the cloth. The formation of the plug also is significant in that the disposition of the folds of the plug should be such that the folds can be withdrawn easily from the plug at the front of the machine without being caught under the plug. This effect of the deflecting plate inclination on the deflecting plate inclination on the disposition of the folds in the plug formation is illustrated in FIG. 22 where it is seen that the opened deflecting plate 104 directs the liquid and rope downwardly to the bottom of the slowly advancing plug. As the liquid and rope are stopped by the plug, the following liquid and cloth are thrown up by the presence of the preceding liquid and then the liquid recedes and the following liquid and rope fall to the bottom to form another fold in a wave pattern. In this manner, the lower the deflecting plate 104 is inclined, the more the cloth folds will be rearwardly inclined, and, conversely, the higher the deflecting plate is inclined, the more vertical the folds will be disposed.

The height of the plug, and therefor the amount of exposed plug above the liquid level in the treating chamber, is variable in relation to the rate of liquid flow, size and weight of the fabric, speed of the advancing plug and angle of the deflecting plate.

The inclination of the deflecting plate 104 shown in FIG. 22 is an intermediate position. A schematic illustration of the deflecting plate 104 in its uppermost position is shown in FIG. 15. It should be noted, of course, that the folds of the cloth plug are compacted rather than being spaced as shown for illustrative purposes in FIG. 15. A schematic illustration showing the deflecting plate 104 in its lower most position is shown in FIG. 16. In any adjusted position of the deflecting plate 104 the cloth rope is opened to substantially the full extent of the plate 104 as seen schematically in FIG. 17.

Figure 14:
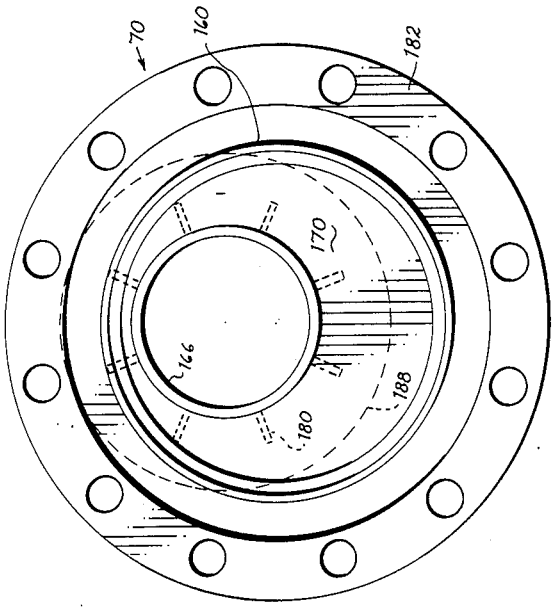
FIG. 14 is a plan view of the liquid jet means of FIG. 13.
Figure 13:
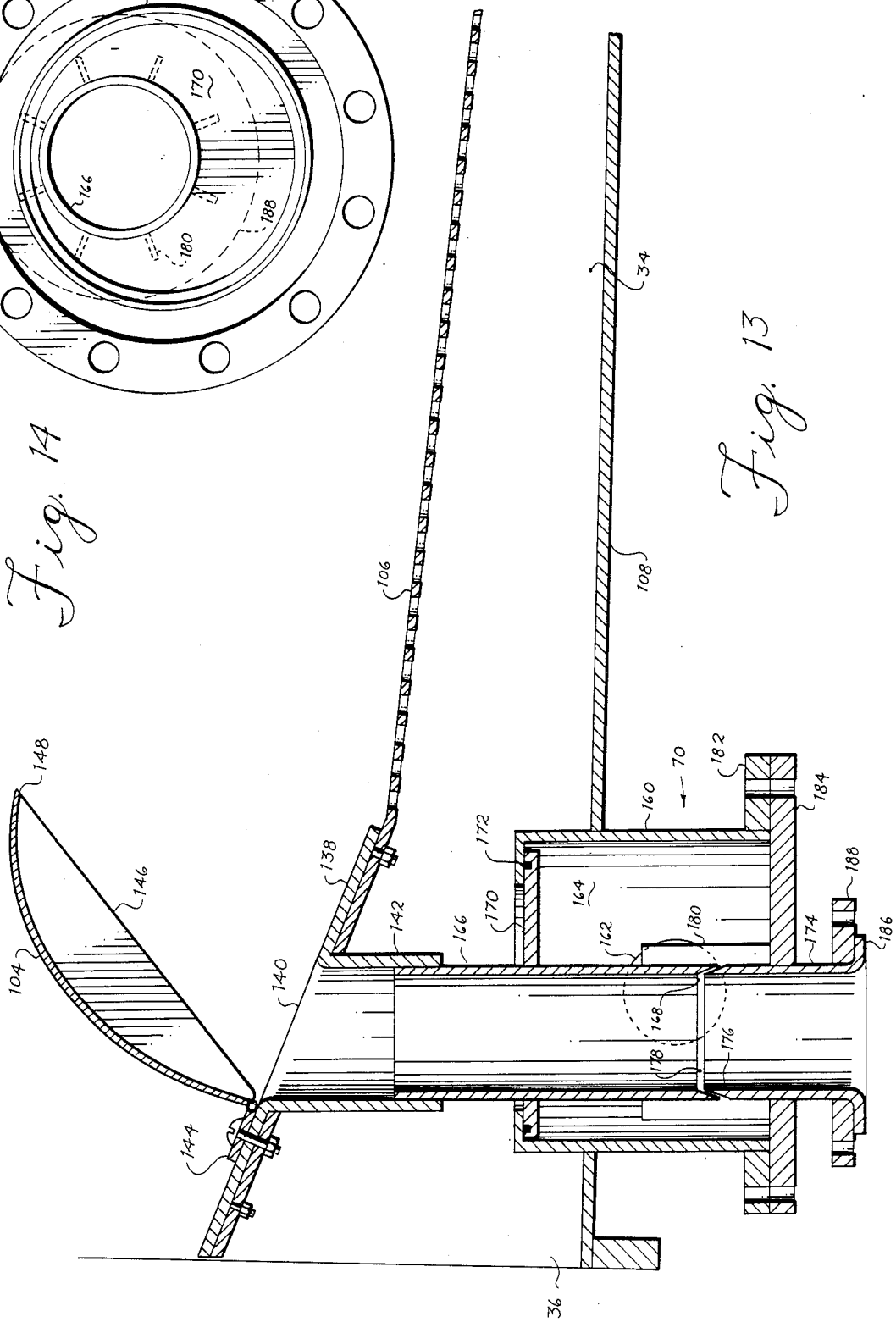
FIG. 13 is a vertical section of the liquid jet means and deflecting plate disposed at the entry end of the treating chamber of FIG. 1.

The treating liquid and cloth rope is forced upwardly into the treating chamber 34 against the deflecting plate 104 by the rear liquid venturi or jet means 70 adjacent the entry end 36 of the treating chamber 34, which serves to inject treating liquid into the cloth return tube 40 in the direction of the entry end 36 to apply a directional impetus to the cloth rope, which not only forces the liquid and rope upwardly against the deflecting plate, but also serves to draw the cloth rope through the return tube. This rear venturi or jet means 70, as best illustrated in the enlargements of FIGS. 13 and 14, comprises a housing 160 secured in the bottom of the treating chamber 34 and projecting downwardly therefrom to provide an inlet 162 to which the rear venturi conduit 68 is attached for flow of treating liquid into the plenum chamber 164 defined by the interior of the housing 160. An upper jet pipe 166 extends upwardly from within the housing 160 into the tubular duct 142 of the entry plate 138 to provide for continuous flow of treating liquid and the cloth rope through the entry opening 140 into the treating chamber 34 and against the deflecting plate 104. The upper jet pipe 166 terminates within the plenum chamber 164 at an end 168 that is formed with an upwardly and inwardly tapered frusto-conical configuration. The upper jet pipe 166 is mounted in the top of the housing 160, with a flat seal ring 170 mounted on the pipe 166 for sealing against the interior of the top of the housing 160 by an annular gasket 172.

A lower jet pipe 174 extends into the plenum chamber 164 in vertical alignment with the upper jet pipe 166 and has its upper end 176 outwardly tapering in a frusto-conical configuration complimentary to the lower end 168 of the upper jet pipe 166 and at a predetermined spacing therefrom to provide an annular conical injection port 178 through which treating liquid in the plenum chamber 164 is forced upwardly through the upper jet pipe 166 to provide the impetus to the cloth rope. The spacing between the upper jet pipe 166 and the lower jet pipe 174 to provide the predetermined venturi or jet opening 178 is fixed by vertical plates 180 spaced circumferentially around the upper and lower jet pipes 166 and 174 and welded thereto. These plates 180 also serve to reduce turbulance of the flow into the jet opening 178 for more effective venturi or jet functioning. The plates 180 are secured at their bottom ends to a horizontal flange 184 that forms the bottom of the housing 160 and is secured to the periphery thereof at an annular flange 182, which securement applies pressure to the seal rings 170 to seal the gasket 172 in place. The lower jet pipe 174 projects downwardly below the housing 160 and has a stub end 186 on which is supported an annular connecting flange 188 for attachment of the cloth return tube 40 with the stub end 186 sealed therebetween.

In some applications it may not be necessary or even desirable to use a rear jet means 70, in which case the apparatus can be outfitted simply with a continuous tube extending from the tubular duct 142 of the entry plate 138 down to connection with the cloth return tube 40.

Further, the rear jet means 70 can take various other forms, such as the alternate embodiment illustrated in FIGS. 20 and 21, in which the alternate jet means 190 comprises a toroidal housing 192 that is mounted between the lower stub end 194 of a connecting pipe 196 that extends downwardly from the tubular duct 142 of the entry plate 138 exteriorly below the bottom of the treating chamber 34, and the upper stub end 198 of the cloth return tube 40, by clamping bolts 200 located beyond the exterior of the housing 192. This alternate embodiment could alternately be mounted near the rear end of the horizontal extent of the cloth return tube 40.

The housing 192 of the alternate jet means 190 forms an annular plenum chamber 202 interiorly thereof, with a connecting duct 204 extending exteriorly of the housing 192 for connecting by a clamping plate 206 to the rear venturi conduit 68 for flow of treating liquid into the plenum chamber 202. This treating liquid is injected as a jet into the cylindrical space defined by the housing 192 as a continuation of the cloth return tube 40 by a plurality of elongated passages 208 formed by cylindrical projections 210 on the interior wall of the housing 192. These cylindrical projections 210 extend from openings 212 spaced from but relatively close to the outer wall of the housing 192 at an upward and inward inclination to jet ports 214 formed in the inner wall of the housing 192, to which the cylindrical projections 210 are formed integrally. Thus, as treating liquid is introduced through the rear venturi conduit 68 into the annular plenum chamber 202, it circulates to the openings 212 in the cylindrical projections 210 and passes therethrough as a jet stream of liquid through the jet ports 214 to provide the impetus to force the cloth rope and treating liquid into the treating chamber 34 against the deflecting plate 104.

Figure 11:
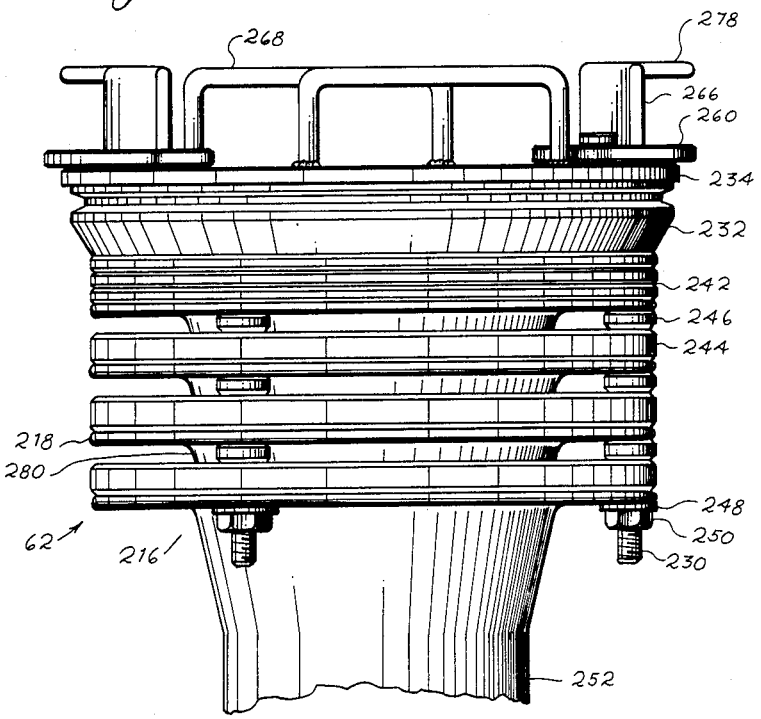
FIG. 11 is a side elevation of the liquid injection nozzle assembly of FIG. 10.
Figure 12:
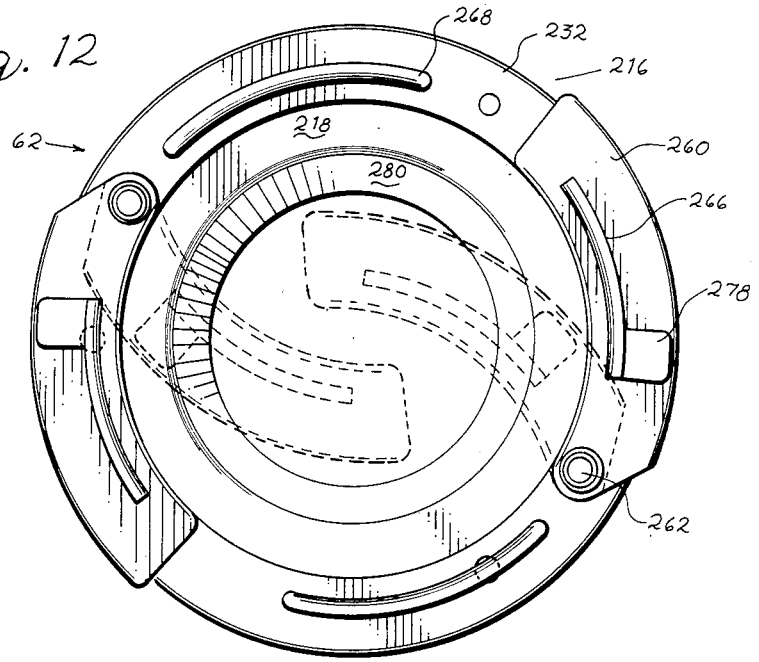
FIG. 12 is a plan of the liquid injection nozzle assembly of FIG. 10.

The front venturi or jet means 62, as illustrated in the enlargements of FIGS. 10, 11, and 12, is mounted in the cloth return tube 40 adjacent the front exit end 38 of the treating chamber 34. This front jet means 62 comprises a removable liquid injection nozzle assembly 216 that can be removed from and replaced in the cloth return tube 40 and adjusted in capacity to provide effective venturi or jet action for different weights and types of fabric in the cloth rope. The cloth return tube 40 extends downwardly adjacent the entry end 36 of the treating chamber 34 and the nozzle assembly 216 is mounted in the downward extent of the tube for injection of treating liquid downwardly away from the treating chamber 34.

The nozzle assembly 216 includes a plurality of partially overlapping nozzle segments 218 that are removably secured together in spaced relation to provide nozzle openings 220 for injection therethrough of treating liquid into the cloth return tube 40 in the downstream direction away from the exit end 38 of the treating chamber 34 to draw the cloth rope from the treating chamber and transport it through the return tube 40. These nozzle segments 218 are mounted inwardly in the return tube 40 with upper and lower end seals 222 and 224 closing the cloth tube to form a plenum chamber 226 therebetween for distribution of treating liquid through an intake port 228 from the front venturi conduit 60 and through the nozzle openings 220.

The nozzle segments 218 are mounted by assembly rods 230 to a top closure ring 232 that has an outwardly projecting shoulder that seats on a mating inwardly projecting shoulder 236 of an annular supporting bracket 238 that is fixed in the cloth return tube section 240 in which the nozzle assembly 216 is located. The top closure ring 232 carries the upper end seal 222 for sealing engagement with the supporting bracket 238.

The assembly rods 238 are secured in the top closure ring 232 and extend downwardly through openings adjacent the periphery of the nozzle segments 218. The uppermost of the nozzle segments 218 is spaced from the top closure ring 232 by a plurality of annular spacer rings 242 through which the assembly rods 230 extend. These spacer rings 242 are selected in number as desired to space the nozzle segments 218 below the top of the plenum chamber 226 for most effective flow of the treating liquid to and through the nozzle openings 220. For effective treating liquid flow with reduced turbulance, an annular ring 244 is located on top of each of the nozzle segments 218 below the uppermost segment, and to provide adequate spacing for flow of the treating liquid from the plenum chamber 226 into the nozzle openings 220 and to provide the necessary spacing of the nozzle segments 218 to form the necessary vertical extent of the nozzle openings 220, spacer elements 246 are mounted on the assembly rods 230 above each annular ring 244. The top closure ring 232, top spacer rings 242, annular rings 244, spacer elements 246 and nozzle segments 218 are secured in assembled position on the assembly rods 230 by lock washers 248 and nuts 250.

The lowermost of the nozzle segments 218 is formed with a downward cylindrical extension 252 that extends through an annular bottom flange 256 that is secured in and extends inwardly from the cloth return tube section 240. This nozzle segment extension 252 also extends through an annular bottom closure plate 254 that seats on the inwardly extending bottom flange 256 with the bottom end seal 224 disposed between the bottom closure plate 254 and the bottom flange 256. A plurality of vertical baffle plates 258 are secured to and project inwardly from the walls of the cloth return tube section 240 to reduce turbulence in the plenum chamber 226. The main section of the cloth return tube is secured by bolts to the bottom flange 256 of the cloth return tube section 240.

The nozzle assembly 216 is removably mounted in the cloth return tube section 240 by a plurality of arcuately shaped latching elements or plates 260 disposed at the upstream end of the nozzle assembly being pivoted for lateral movement on stub shafts 262 projecting upwardly from the top closure ring 232 so that the latching plates 260 can pivot from a retracted non-latching position within the periphery of the top closure ring 232 to a latching position laterally outward of the periphery of the top closure ring 232 in latching engagement in annular grooves 264 in the supporting bracket 238. The latching plates 260 have upwardly extending arcuate support plates 266, and the top closure ring 232 has upwardly extending support rods 268, with the support rods 268 and support plates 266 extending upwardly to a common height and being disposed in a common circle when the latching plates 260 are in the latching position. The inter-relation of the support plates 266 and support rods 268 provides means for supporting an annular latch retaining segment 270 removably mounted over the latching elements in the upstream direction and having an annular horizontally extending flange 272 supportable on the plates 266 and rods 268, and a frusto-conical inwardly extending portion 274 that extends downwardly and inwardly in the downstream direction along the support plates 266 and support rods 268 in retaining engagement with the latching plates 260 inwardly thereof to retain them in latching disposition. The latch retaining segment 270 is removable to permit unlatching of the latching plates 260 for removal of the assembly 216, and is removably retained in latch retaining position by L-shaped brackets 276 that project downwardly from the underside of the horizontally extending flanges 272 and engage under horizontally projecting fingers 278 on the outer side of the support plates 266. The L-shaped brackets 276 all face in the same rotational direction so that the latch retaining segment 270 can be rotated in one direction to engage the L-shaped brackets 276 under the fingers 278 to retain the assembly 216 in latched position, and can be rotated in the opposite direction to release the latch retaining segment 270 and allow unlatching of the assembly 216 from the cloth return tube section 240. In this manner, the nozzle assembly 216 can be removed and modified as desired by removing or substituting different sized nozzle segments 218, spacer rings 242, annular rings 244 and spacer elements 246, thereby varying the size and number of the nozzle openings 220 for optimum jet means functioning compatible with the weight and type of cloth being handled.

The aforementioned frusto-conical shape of the inwardly extending portion 274 of the latch retaining segment 270 serves to guide the cloth rope and treating liquid exiting from the treating chamber 34 into a contracted tube size as the cloth and liquid enter the nozzle assembly 216. Each of the other nozzle segments 218 also includes an inner frusto-conical portion 218 tapering downwardly and inwardly in the downstream direction of flow of the cloth and treating liquid through the nozzle so that the treating liquid jet flow is directed through the nozzle openings 220 by the frusto-conical portions 280 in the downward direction to provide the impetus to force flow of the cloth and liquid downwardly through the cloth return tube 40. The frusto-conical 280 of adjacent nozzle segments 218 partially overlap inwardly in spaced relation and in a downstream direction to form the nozzle openings.

As the cloth rope and treating liquid are propelled from the front venturi or jet means 62 they flow through the cloth return tube 40, with the treating liquid flowing with a natural turbulence, particularly where it changes direction at the bends in the tube. This turbulence tends to impart a twisting action to the cloth rope, particularly when there is no rear venturi or jet means to pull the cloth rope through the tube and all of the transport force is a pushing force from the front venturi. This twisting can have some effect on the ability of the cloth rope to open fully at the deflecting plate 104, and particularly can pose a problem when two cloth ropes are being processed in "piggyback" fashion wherein the twisting causes a problem in separating the cloth ropes when they are being doffed.

Figure 26:
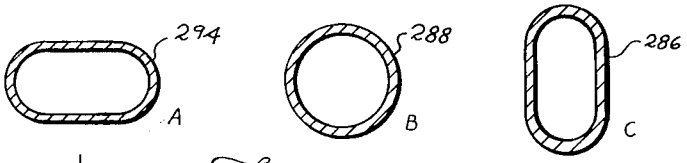
FIG. 26 is a series of transverse vertical sections of the cloth return tube of FIG. 25 taken along the lines indicated in FIG. 25.
Figure 25:
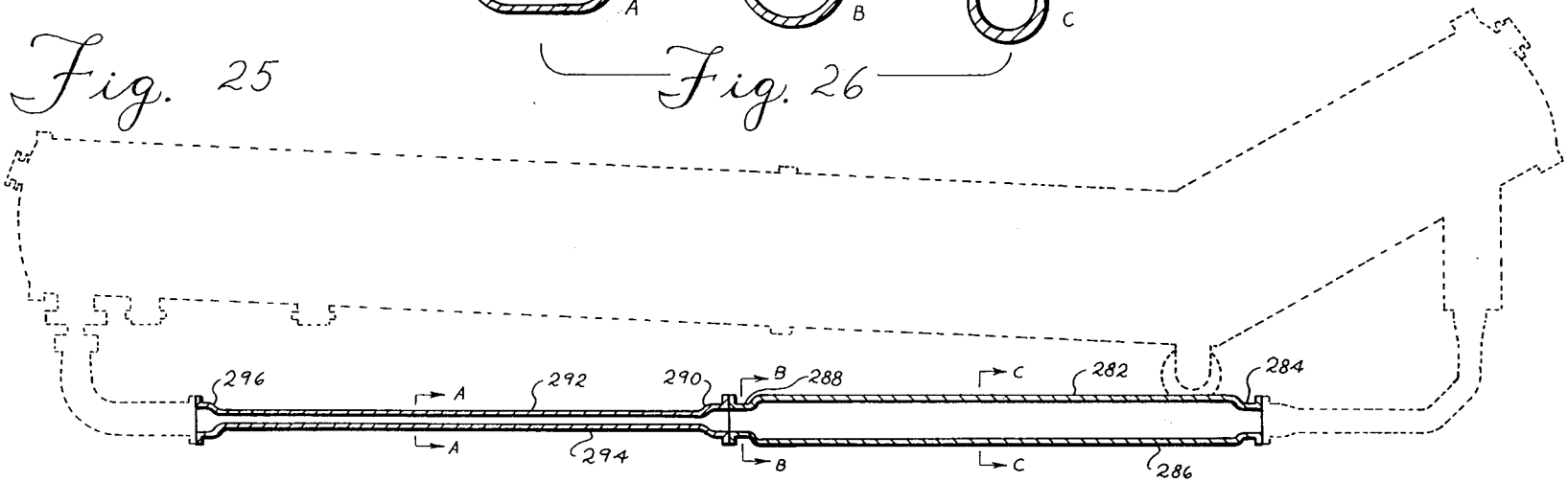
FIG. 25 is a vertical section of an alternate form of the cloth return tube of the apparatus of the present invention showing the treating chamber in outline.

To reduce the twist-causing turbulence and the confine the cloth rope to a generally non-twisting central disposition in the cloth return tube 40, the tube can be modified by forming lengthwise flutes therein, or it can be formed with a flattened cross-section as illustrated in the alternate embodiment of FIGS. 25 and 26. In this embodiment the cloth return tube has a first straight section 282 that starts at its front end 284 in a circular cross-section for connection to the lead-in section of the cloth return tube and then is flattened widthwise through a major portion 286 of its length and then returns to a circular cross-section at its rear end 288, at which it is connected to the front circular end 290 of a second straight section 292 of the cloth return tube, which is flattened heightwise through a major portion 294 of its length and then returns to a circular cross section at its rear end 296 for attachment to the trailing portion of the cloth return tube. In this manner, the cloth rope is somewhat stable as it progresses through each of the flattened sections 282 and 292 and is reoriented for improved exposure to the treating liquid as it progresses from one flattened section into the next. The cross-section of the sections is illustrated in FIG. 26.

The circulation of the cloth rope and treating liquid through the apparatus 30 is illustrated diagramatically in FIG. 22, in which it is seen that the front venturi or jet means 62 pulls the cloth rope R downwardly and forces it and the treating liquid L through the cloth return tube 40, with the rope R progressing in generally unfolded extension from the front exit end 38 of the treating chamber 34 to the rear entry end 36 for return into the treating chamber 34. The rear venturi or jet means 70, when used, impels the cloth rope R and treating liquid L upwardly from the cloth return tube, thereby pulling the cloth rope R through the tube and directing the rope R and treating liquid L upwardly against the deflecting plate 104 in the rear of the treating chamber 34. The deflecting plate 104 intercepts the rope R and liquid L, opening the rope and directing it and the liquid forwardly at an angle determined by the adjustable setting of the deflecting plate 104 to form the rope R into vertical folds that are compacted progressively to form a plug P of a height that extends above the level of the liquid L within the treating chamber 34 so that the plug has a portion exposed above the treating liquid level. This formation of the extension of the folds and plug to extend above the liquid level advantageously results in entrainment of air in the folds as they are being formed, which minimizes possible creasing and facilitates reorientation of the cloth rope.

The plug P progresses through the treating chamber 34 by advancing down the rear liner 106, along the treating chamber 34 between the rear and front liners, 106 and 118, and then up the front liner 118 to the plug stop plate 120, from which the lifter reel 84 and the front venturi or jet means 62 pulls the cloth rope from its folded plug condition through the pot eye bracket 124, which prevents folds of cloth from advancing therepast. Treating liquid L is introduced under the plug stop plate 120 to overflow forwardly in the treating chamber 34 and into the front venturi or jet means 62 to facilitate flow of the cloth rope R therethrough.

As the plug P progresses through the treating chamber 34 it is subjected to a spray of treating liquid from the plurality of spray means openings 128 in the top of the treating chamber 34. This spray applies treating liquid L over the exposed portion of the plug P and also wets the top surface of the interior of the treating chamber 34 to prevent condensation and undesirable dripping of treating liquid from the treating chamber surface onto the exposed plug.

With this arrangement, treating liquid is introduced into the apparatus 30 at the front venturi or jet means 62, at the rear venturi or jet means 70 and at each of the spray means openings 128 of the spray means 126. Thus, the cloth rope R is exposed to fresh recirculating treating liquid L at a plurality of locations during each cycle through the apparatus 30. This importantly results in faster treatment capabilities and faster temperature change capabilities such that the apparatus 30 can operate at speeds substantially faster than conventional machines that introduce treating liquid at only one location in the circulating cycle of the cloth rope. With fabrics that are delicate and require gentle handling, the rate of travel of the cloth rope through the apparatus can be slowed down as needed for gentle handling while the multiple application of treating liquid accomplishes effective treatment in a reasonable cycle time.

The cloth rope R is loaded into the apparatus 30 by opening the front cover plate 90, starting circulation of the treating liquid through the apparatus, and then feeding one end of a length of cloth into the front end 38 of the apparatus 30 and into the front venturi or jet means 62, which draws the cloth rope R into the cloth return tube 40. The circulating treating liquid carries the leading end of the cloth rope through the cloth return tube 40 and back through the treating chamber 34 to the front end, where it can be removed over the lifter reel 84 and held until the full length of the cloth has been pulled into the apparatus. The two ends of the cloth are then sewn together and the front cover plate 90 closed to permit the apparatus to operate through a treating cycle. When the cycle has been completed, the front cover plate 90 is opened and the cloth rope circulated until the seam is found. The seam is opened and the leading end is then entrained around the doffing reel 88 for removal of the treated cloth rope from the apparatus.

Figure 27:
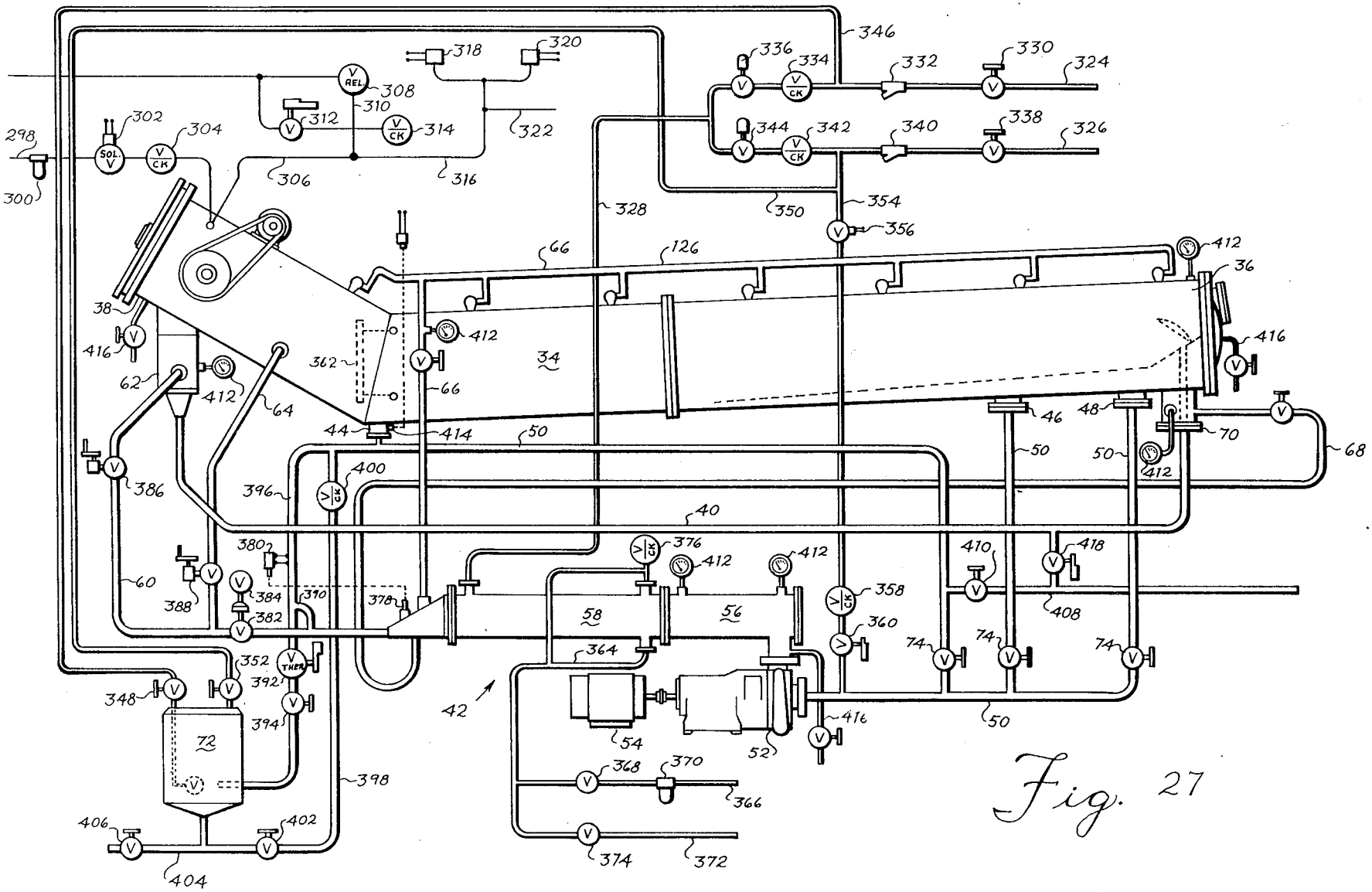
FIG. 27 is a schematic diagram of the treating liquid circulating system and electrical controls for the apparatus of FIG. 1.

The details of the steam, water and air system for operating the apparatus 30 is illustrated schematically in FIG. 27. Air under pressure is introduced to pressurize the air space in the treating chamber 34 above the treating liquid L through an air supply line 298 from a conventional source. This air supply line 298 includes a filter 300, a solenoid control valve 302 and a check valve 304. The air supply line 298 opens into the treating chamber 34 at the top of the front end 38 thereof. Also, at the top of the front end 38 is connected an air relief line 306 that has a vent valve 312 that is openable to allow pressurized air to escape from the treating chamber 34 to a drain at the completion of a cycle or when otherwise desired, particularly in preparation for opening of either the cover plate 90 and 100 of the rear access door 102. The air relief line 306 also includes a branch line 310 that includes a relief valve 308 and a vacuum breaker 314. A control line 316 extends from the air relief line 306 for connection to a sensor 318 for a safety switch and a sensor 320 for line pressure. The air relief line 306 is also connected by a branch line to a main controller (not shown).

Steam and water are alternatively introduced to the heat exchanger 58 through a steam line 324 from a source of steam and a water line 326 from a source of water. The steam line 324 and water 326 combine in a common line 328 leading to the heat exchanger 58 for introduction of either steam or water to the heat exchanger depending on whether heating or cooling is being done at a particular time in the operating cycle. A cutoff valve 330, strainer 332, check valve 334, and control valve 336 are located in the steam line 324, and corresponding cutoff valve 328, strainer 340, check valve 342 and control valve 344 are located in the water line 326. A branch 346 of the steam line branches off between the strainer 332 and check valve 334 and leads to the "add" tank 72 for introduction of steam to the tank when desired through a valve 348. A similar branch 350 of the water line 326 branches from between the strainer 340 and check valve 342 and leads to the "add" tank 72 through a valve 352 for adding water to the "add" tank when desired. A water feed line 354 extends from the water line branch 350 to the circulating liquid conduit 50 adjacent the pump 52 for introducing water into the apparatus at start-up or at any time during operation. This water feed line includes a flow meter 356, a check valve 358 and a control valve 360 to open and close the line. The flow meter 356 is used to monitor the quantity of liquid being introduced into the apparatus so that the liquid level in the treating chamber is at a predetermined height for desirable operating conditions.

A liquid level gauge 362 is mounted outside the treating chamber 34 to indicate the level of liquid in the treating chamber 34, and functions during washing cycles, during which the control valve 360 is open to introduce wash water, to provide the sensing for opening and closing the drain valve 410 to maintain the wash water level at a desirable operating height. During this washing, the wash water is drained from the front drain 44 through the drain valve 410 to drain the most contaminated liquid from the apparatus.

The steam or water that is introduced into the heat exchanger 58 is removed at the end of the path of circulation through the heat exchanger through a drain line 364 that branches into a condensate return line 366 having a control valve 368 and a steam trap 370 therein and leading to a condensate return, and a water return line 372 that has a control valve 374 and leads to a water return. A vacuum breaker valve 376 is also connected to the heat exchanger and communicates with the drain line 364.

The conduits 50 leading from the front drain 44, intermediate drain 46, and rear drain 48 on the underside of the treating chamber 34 each have a butterfly valve 74 for independent adjustment of the flow from the individual drains as the treating liquid is circulated from the treating chamber 34 to the pump 52 for recirculation. By adjusting these control valves 74, the flow of treating liquid through and from the treating chamber 34 can be regulated for optimum operating conditions and for control of proper progression of the cloth plug through the treating chamber. Thus, by increasing the flow through the front drain 44 in comparison with the other drains, there will be increased forward flow of the treating liquid in the chamber with an accompanying increased forward advance of the cloth plug, which may be necessary if it is observed that the cloth plug is compacting unduly at the rear of the chamber and is not properly advancing. Conversely, if the plug is advancing excessively at the front of the chamber, which may be interfering with unfolding of the cloth from the plug or binding of the cloth so that it can not properly be pulled from the chamber by the front venturi, the valve 74 for the intermediate drain 46 and/or the valve for the rear drain 48 can be opened wider than the valve 74 for the front drain 44 to slow down forward flow of the treating liquid and the cloth plug in the treating chamber.

The circulating treating liquid, as it leaves the heat exchanger 58, passes through the front venturi conduit 60, rear venturi conduit 68, and spray means conduit 66. The front venturi conduit 60 includes an opening valve 382 that is slow opening to start-up circulation and has a quick close control 384 to stop feed of the treating liquid to the venturi when conditions require. The front venturi conduit 60 also includes a manually operable throttle valve 386 to control the volume of liquid flowing to the front venturi 62 for control of the circulating force being applied to the circulating cloth rope. The overflow section conduit 64 branches from the front venturi conduit 60 and includes a manually operable control valve 388 to adjust the volume of flow into the treating chamber 34 under the plug stop plate 120 for overflow into the front venturi 62. Also, leading from the front venturi conduit 60 is a bypass conduit 390 connected to a conduit 396 that extends from the "add" tank 72 to the drain conduit 50. This bypass conduit 390 is substantially smaller in diameter than the front venturi conduit 60 so that only a relatively small portion of the circulating liquid passes therethrough, but it is of a size to create sufficient flow of pressurized liquid from the heat exchanger 58 through the conduit 396 and an adductor (not shown) at the juncture of the conduit 396 and another conduit 398 from the bottom of the "add" tank 72 to draw liquid from the tank into the drain conduit 50 and thereby add chemicals from the tank into the circulating liquid. To control this chemical adding a control valve 402 and a check valve 400 are located in the add conduit 398.

A control valve 394 is located in the extension of the conduit 396 to the "add" tank 72 beyond the bypass conduit 390 to normally close the extension so that liquid flows to the drain conduit 50. However, when it is desired to feed treating liquid into the "add" tank 72 for addition of chemicals thereto, the control valve 394 is opened and the liquid from the bypass conduit 390 flows through the extension into the tank. To prevent this flow when the temperature of the liquid is above a safe level, a temperature responsive valve 392 is also located in the extension.

At the end of a cycle, treating liquid is drained from the treatment chamber 34 through the front drain conduit 50 and a connecting conduit 408, in which a drain valve 410 is located, and from the cloth return tube 40, and therefore from the front and rear venturis, through a drain valve 418.

Pressure gauges 412 are located for system monitoring purposes in the front venturi 62, rear venturi 70, rear end 36 of the treating chamber 34, and at opposite ends of the filter 56. Also, for monitoring purposes a temperature sensor 378 is located at the discharge end of the heat exchanger 58. A temperature sensor 414 is located in the front drain 44 as a safety to indicate when the temperature is above the atmospheric boiling temperature such that the system should not be depressurized. A sensor/switch 380 is responsive to the temperature in conduit 396 and at the discharge of the heat exchanger 58 to shut the apparatus down when the temperature is excessive.

To protect against inadvertent opening of the front cover plate 90, rear access door 100, and the filter 56 when the system is pressurized, safety test valves 416 are located at the filter 56 and at each end of the treating chamber for opening to test the condition in the treating chamber.

In a typical operation, the cycle begins by introducing water into the conduits and treating chamber to the desired level, then initiating circulation of the water and loading the cloth as described above. The valves are then manipulated to add chemicals from the "add" tank into the circulating liquid. Next, dye is added and the temperature raised by circulating the liquid through the heat exchanger. The circulation then continues for the necessary running time, following which the heat exchanger is operated to cool the circulating liquid. The cloth is then washed by introduction of clean water, and finally the cloth is unloaded. The cycle can be varied as desired for particular treating functions, including having several different chemical adding runs and dyeing runs as well as heating, cooling, and washing cycles. Depending on the particular processing cycle and the capability of the cloth to withstand the physical strain of high speed circulation, savings in cycle time of as much as twenty percent may be experienced in some applications, or fabrics that cannot withstand normal operating speeds can be treated at slower speeds but in reasnable total cycle times where it was not previously practical to treat such delicate fabrics with conventional apparatus of this general type.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. Apparatus for wet treatment of endless cloth rope comprising a generally horizontally extending cloth treating chamber for containing treating liquid and through which chamber said cloth rope progresses in a plug of generally vertical folds from an entry end to an exit end for treatment by said liquid, a cloth return tube extending between said exit and entry ends and through which said cloth rope progresses in generally unfolded extension from said exit end of said treating chamber to said entry end for return into said treating chamber, treating liquid circulating means operable to withdraw treating liquid from said treating chamber and to direct treating liquid through said cloth return tube in a direction for discharge into said treating chamber at said entry end thereof such that said circulating treating liquid transports said cloth rope through said cloth return tube back into said treating chamber, means for causing said cloth rope to entrain air therein and form into said plug as it enters said treating chamber, said liquid circulating means maintaining the treating liquid in said treating chamber at a predetermined level lower than said plug height so that a portion of the cloth plug is exposed above the treating liquid level for continued entrainment of air therein, and said liquid circulating means including spray means for directing a portion of the treating liquid into said treating chamber at a plurality of openings spaced along the length of said chamber intermediate its ends and above said cloth plug to apply treating liquid to the exposed portion of said cloth plug at a plurality of locations as it progresses through said chamber, said openings being disposed and shaped for distribution of said treating liquid across substantially the full width of said cloth rope plug and along substantially the full length thereof for treating of said exposed plug portion and for progressively adding to the treating liquid in the chamber to facilitate treating of the plug as it progresses through said chamber, a vortex chamber mounted exteriorly on said treatment chamber above each opening, each vortex chamber converging conically from an enlarged upper portion to said opening and having an entry opening in said upper portion, and a supply conduit connected to the upper portion of each said vortex chamber and extending generally tangentially with respect thereto for introduction therethrough of treating liquid tangentially into said vortex chamber to cause said treating liquid to form a vortex as it flows downwardly through said vortex chamber and spray opening to form a dispersing spray in said treating chamber.

2. Apparatus for wet treatment of endless cloth rope according to claim 1 and characterized further in that said openings are disposed and shaped to direct said treating liquid over substantially the entire interior surface of said treating chamber above said cloth rope plug to prevent condensate from forming on said surface and dripping as contaminant onto said cloth rope plug.

3. Apparatus for wet treatment of endless cloth rope according to claim 1 and characterized further in that said treating chamber is generally cylindrically domed in cross-section above the level of treating liquid therein and said openings are disposed and shaped for spraying of treating liquid over substantially the entire surface of said chamber above said plug of cloth rope.

4. Apparatus for wet treatment of endless cloth rope according to claim 1 and characterized further in that said spray openings flare circumferentially outwardly to merge into the interior surface of said treating chamber to facilitate dispersion of the treating liquid spray as it enters said treating chamber.

5. Apparatus for wet treatment of endless cloth rope according to claim 1 and characterized further by heat exchanging means through which said treating liquid is passed by said circulating means exteriorly of said treating chamber and cloth return tube in advance of directing said liquid through said cloth return tube and through said openings, thereby distributing the temperature differential of heat exchange between said liquid and cloth rope incrementally along said cloth rope plug.

6. Apparatus for wet treatment of endless cloth rope according to claim 1 and characterized further in that said treating liquid circulating means directs said treating liquid for discharge upwardly into said treating chamber from the underside thereof at said entry end thereof, and said plug forming means comprises an imperforate deflecting plate having a generally straight lateral extent substantially equivalent to the full width of said treating chamber and being inclined upwardly and progressively forwardly in its longitudinal extent, said deflecting plate being disposed above the entry of said rope and treating liquid into said treating chamber to intercept and redirect said treating liquid and cloth forwardly along the surface of said plate, and said circulating means causing said cloth rope and treating liquid to enter said treating chamber at a sufficient velocity to maintain said cloth rope in contact with said plate for a sufficient longitudinal extent to cause said cloth to open to substantially the full width of said treating chamber.

7. Apparatus for wet treatment of cloth in endless rope form comprising a generally horizontally extending cloth treating chamber for containing treating liquid and through which chamber said cloth rope progresses in a plug of generally vertical folds from an entry end to an exit end for treatment by said liquid, a cloth return tube extending between said exit and entry ends and through which said cloth rope progresses in generally unfolded extension from said exit end of said treating chamber to said entry end for return into said treating chamber, treating liquid circulating means operable to withdraw treating liquid from said treating chamber and to direct treating liquid through said cloth return tube in a direction for discharge into said treating chamber at said entry end thereof such that said circulating treating liquid transports said cloth rope through said cloth return tube back into said treating chamber, means for causing said cloth rope to form into said plug as it enters said treating chamber, said liquid circulating means including spray means mounted exteriorly of said treating chamber in communication with a plurality of openings in said chamber at spacings along the length thereof intermediate its ends for directing a portion of the treating liquid into said treating chamber as a dispersing spray through said plurality of openings to apply treating liquid to said cloth plug at a plurality of locations as it progresses through said chamber to facilitate treating of the plug as its progresses through said chamber and to apply treating liquid to the interior surface of said chamber above said cloth rope plug to prevent condensate from forming on said surface and dripping as contaminant onto said cloth rope plug, said spray means including a vortex chamber mounted exteriorly on said treatment chamber above each opening, each vortex chamber converging conically from an enlarged upper portion to said opening and having an entry opening in said upper portion, and a supply conduit connected to the upper portion of each said vortex chamber and extending generally tangentially with respect thereto for introduction therethrough of treating liquid tangentially into said vortex chamber to cause said treating liquor to form a vortex as it flows downwardly through said vortex chamber and spray opening to form a dispersing spray in said treating chamber.

8. Apparatus for wet treatment of endless cloth rope according to claim 7 and characterized further in that said spray openings flare circumferentially outwardly to merge into the interior surface of said treating chamber to facilitate dispersion of the treating liquid spray as it enters said treating chamber.

9. Apparatus for wet treatment of cloth in endless rope form comprising a generally horizontally extending cloth treating chamber for containing treating liquid and through which chamber said cloth rope progresses in a plug of generally vertical folds from an entry end to an exit end for treatment by said liquid, a cloth return tube extending between said exit and entry ends and through which said cloth rope progresses in generally unfolded extension from said exit end of said treating chamber to said entry end for return into said treating chamber, treating liquid circulating means operable to withdraw treating liquid from said treating chamber and to direct treating liquid through said cloth return tube in a direction for discharge upwardly into said treating chamber from the underside thereof at said entry end thereof such that said circulating treating liquid transports said cloth rope through said cloth return tube back to said treating chamber and upwardly thereto, deflecting means for causing said cloth rope to open to substantially the full width of said treating chamber and to form into said plug as it enters said treating chamber, said deflecting means being an imperforate plate disposed above the rope and liquid discharge of said cloth return tube at said entry end, said plate having a generally straight lateral extent substantially equivalent to the full width of said treating chamber and being curvingly inclined upwardly and progressively forwardly in its longitudinal extent as a generally smooth continuation of said cloth return tube to minimize impact of said rope and treating liquid with said plate and, said deflecting plate being disposed above the entry of said rope and treating liquid into said treating chamber to intercept and redirect said treating liquid and cloth forwardly along the surface of said plate, the imperforate nature of said plate being effective to generally retain at least a portion of the circulating liquid upon discharge from said cloth return tube to provide a liquid layer along said plate to deter contact of said rope with said plate, and said circulating means causing said cloth rope and treating liquid to enter said treating chamber at a sufficient velocity to maintain said cloth rope in contact with said plate for a sufficient longitudinal extent to cause said cloth to open to substantially the full width of said treating chamber.

10. Apparatus for wet treatment of endless cloth rope according to claim 9 and characterized further in that said liquid circulating means maintains the treating liquid in said treating chamber at a predetermined level, and said deflecting plate directs said cloth rope forwardly above said predetermined level of treating liquid to entrain air therein and to form said plug with a height to extend above the predetermined level of treating liquid so that a portion of said plug extends above said treating liquid as the plug progresses through said treating chamber.

11. Apparatus for wet treatment of endless cloth rope according to claim 10 and characterized further in that said treating liquid circulating means includes liquid jet means adjacent said entry end of said treating chamber for injecting treating liquid into said cloth return tube in the direction of said entry end to apply a directional impetus to said cloth rope to draw it through said return tube and to force it into said chamber.

12. Apparatus for wet treatment of endless cloth rope according to claim 11 and characterized further in that said treating liquid circulating means includes liquid jet means adjacent said exit end of said treating chamber for injecting treating liquid into said cloth return tube in the direction of travel of said cloth rope to said entry end to apply a directional impetus to said cloth rope to draw it from said treating chamber and force it through said cloth return tube.

13. Apparatus for wet treatment of endless cloth rope according to claim 9 and characterized further in that said deflecting plate is adjustably mounted in said treating chamber for adjustment of the upward and forward inclination thereof to adjust the inclination of the cloth folds being formed into the cloth plug.

14. Apparatus for wet treatment of endless cloth rope according to claim 13 and characterized further in that said deflecting plate is pivotally mounted in said treating chamber at a pivot beyond the location of the entry of the cloth rope into the treating chamber.

15. Apparatus for wet treatment of endless cloth rope according to claim 9 and characterized further in that said deflecting plate is formed with its cloth intercepting and redirecting surface concavely shaped longitudinally to facilitate control of said cloth rope in opening fully and in forming said plug.

16. Apparatus for wet treatment of endless cloth rope according to claim 15 and characterized further in that said deflecting plate is formed as a cylindrical segment.

17. Apparatus for wet treatment of endless cloth rope according to claim 15 and characterized further in that said deflecting plate is formed with depending longitudinally extending side walls that confine said cloth rope and treating liquid to the lateral extent of said deflecting plate.

18. Apparatus for wet treatment of endless cloth rope according to claim 9 and characterized further in that said treating liquid circulating means includes liquid jet means adjacent said entry end of said treating chamber for injecting treating liquid into said cloth return tube in the direction of said entry end to apply a directional impetus to said cloth rope to draw it through said return tube and to force it upwardly into said treating chamber against said deflecting plate.

19. Apparatus for wet treatment of endless cloth rope according to claim 18 and characterized further in that said treating liquid circulating means includes liquid jet means adjacent said exit end of said treating chamber for injecting treating lisuid into said cloth return tube in the direction of travel of said cloth rope to said entry end to apply a directional impetus to said cloth rope to draw it from said treating chamber and force it through said cloth return tube.

20. Apparatus for wet treatment of cloth in endless rope form comprising a generally horizontally extending cloth treating chamber for containing treating liquid and through which chamber said cloth rope progresses in a plug of generally vertical folds from an entry end to an exit end for treatment by said liquid, a cloth return tube extending between said exit and entry ends and through which said cloth rope progresses in generally unfolded extension from said exit end of said treating chamber to said entry end for return into said treating chamber, treating liquid circulating means operable to withdraw treating liquid from said treating chamber and to direct treating liquid through said cloth return tube in a direction for discharge into said treating chamber at said entry end thereof such that said circulating treating liquid transports said cloth rope through said cloth return tube back into said treating chamber, means for causing said cloth rope to form into said plug as it enters said treating chamber, said treating liquid circulating means including a liquid injection nozzle assembly removably mounted in said cloth return tube adjacent said exit end of said treating chamber, said liquid injection nozzle assembly comprising a plurality of partially overlapping annular nozzle segments removably secured together in spaced relation to provide nozzle openings for injection therethrough of treating liquid into said cloth return tube in a downstream direction away from said exit end of said treating chamber to draw said cloth rope from said treating chamber and transport it through said return tube and a plurality of arcuately shaped latching elements pivotally mounted on said nozzle assembly for outward pivotal movement, and said cloth return tube being provided with an annular groove formed for receipt of said latching elements upon outward pivoting thereof to removably latch said nozzle assembly in said cloth tube.

21. Apparatus for wet treatment of endless cloth rope according to claim 20 and characterized further in that said latching elements and said annular groove support said liquid injection nozzle assembly in said cloth return tube at an inward spacing therefrom and with end seals to provide a plenum chamber therebetween for distribution of treating liquid to said nozzle openings.

22. Apparatus for wet treatment of endless cloth rope according to claim 20 and characterized further in that said cloth return tube extends downwardly adjacent said entry end of said treating chamber and said liquid injection nozzle assembly is mounted in the downward extent of said cloth return tube for injection of treating liquid by said nozzle assembly downwardly away from said treating chamber.

23. Apparatus for wet treatment of endless cloth rope according to claim 20 and characterized further in that said nozzle assembly includes spacer elements removably mounted between said nozzle segments to provide said nozzle openings between said nozzle segments.

24. Apparatus for wet treatment of endless cloth rope according to claim 23 and characterized further in that said nozzle assembly includes a plurality of spaced assembly rods extending through said nozzle segments and spacer elements to assemble all of the nozzle segments and spacer elements together in said nozzle assembly.

25. Apparatus for wet treatment of endless cloth rope according to claim 20 and characterized further in that each said nozzle segment has an inner frusto-conical portion tapering inwardly in the direction of flow of the treating liquid through the nozzle and with the frusto-conical portions of adjacent nozzle segments partially overlapping inwardly in spaced relation and in a downstream direction to form said nozzle openings.

26. Apparatus for wet treatment of endless cloth rope according to claim 20 and characterized further in that said latching elements are disposed at the upstream end of said nozzle assembly and said nozzle assembly includes an annular latch retaining segment removably mounted over said latching elements in the upstream direction and having an inner frusto-conical portion tapering inwardly in the downstream direction in retaining engagement with said latching elements inwardly thereof to retain said latching elements in latching disposition in said grooves.

27. A liquid injection nozzle assembly for injecting liquid in a downstream direction into a stream of material traveling therethrough, said nozzle assembly comprising a plurality of partially overlapping annular nozzle segments, spacer elements removably mounted between said nozzle segments to maintain them in spaced relation to provide nozzle openings between said nozzle segments for injection therethrough of treating liquid onto said stream of traveling material and a plurality of spaced assembly rods extending through said nozzle segments and spacer elements to assemble all of the nozzle segments and spacer elements together in said nozzle assembly, each said nozzle segment having an inner frusto-conical portion tapering inwardly in the direction of flow of the treating liquid through the nozzle and with the frusto-conical portions of adjacent nozzle segments partially overlapping inwardly in spaced relation and in a downstream direction to form said nozzle openings, and a plurality of arcuately shaped latching elements pivotally mounted on said nozzle assembly for outward pivotal movement for latching in a groove of a surrounding structure.

28. A liquid injection nozzle assembly according to claim 27 and characterized further in that said latching elements are disposed at the upstream end of said nozzle assembly and said nozzle assembly includes an annular latch retaining segment removably mounted over said latching elements in the upstream direction and having an inner frusto-conical portion tapering inwardly in the downstream direction in retaining engagement with said latching elements inwardly thereof to retain said latching elements in latching disposition.

* * * * *

UNITED STATES PATENT AND TRADEMARK OFFICE

CERTIFICATE OF CORRECTION

PATENT NO. : 4,716,744

DATED : January 5, 1988

INVENTOR(S) : James K. Turner, William C. Sturkey, Charles R. Hornbuckle

It is certified that error appears in the above-identified patent and that said Letters Patent is hereby corrected as shown below:

Col. 2, line 26, delete "at".

Col. 3, line 33, delete "flusing" and insert — flushing —.

Col. 3, line 46, delete "therefor" and insert — therefore —.

Col. 4, line 19, delete "creasemarks" and insert — crease marks —.

Col. 4, line 61, delete "is" and insert — are —.

Col. 6, line 55, delete "diagramatic" and insert — diagrammatic —.

Col. 6, line 61, delete "diagramatic" and insert — diagrammatic —.

Col. 11, line 13, delete "on the deflecting plate inclination".

Col. 11, line 27, delete "therefor" and insert — therefore —.

Col. 12, line 6, delete "complimentary" and insert — complementary —.

Col. 15, line 5, after "conical" insert — portions —.

Col. 15, line 23, delete "the" (second occurrence) and insert — to —.

Col. 15, line 47, delete"diagramatically" and insert — diagrammatically —.

Col. 17, line 27, delete "328" and insert — 338 —.

UNITED STATES PATENT AND TRADEMARK OFFICE

CERTIFICATE OF CORRECTION

PATENT NO. : 4,716,744

DATED : January 5, 1988

INVENTOR(S) : James K. Turner, William C. Sturkey, Charles R. Hornbuckle

It is certified that error appears in the above-identified patent and that said Letters Patent is hereby corrected as shown below:

Col. 19, line 47, delete "reasnable" and insert — reasonable —.

Col. 23, line 44, delete "lisuid" and insert — liquid —.

Signed and Sealed this

Fifteenth Day of May, 1990

*Attest:*

HARRY F. MANBECK, JR.

*Attesting Officer*

*Commissioner of Patents and Trademarks*